US011608714B2

(12) United States Patent
Chen

(10) Patent No.: US 11,608,714 B2
(45) Date of Patent: Mar. 21, 2023

(54) SWITCH SLIDING SLEEVE DEVICE FOR OIL-GAS EXPLOITATION AND SWITCHING METHOD THEREOF, OIL-GAS EXPLOITATION TOOL AND SWITCHING METHOD OF WALL THROUGH HOLE THEREOF

(71) Applicant: Aimin Chen, Beijing (CN)

(72) Inventor: Aimin Chen, Beijing (CN)

( * ) Notice: Subject to any disclaimer, the term of this patent is extended or adjusted under 35 U.S.C. 154(b) by 237 days.

(21) Appl. No.: 17/083,563

(22) Filed: Oct. 29, 2020

(65) Prior Publication Data

US 2021/0140272 A1 May 13, 2021

(30) Foreign Application Priority Data

Nov. 12, 2019 (CN) ..... 201911102352.7
Jun. 24, 2020 (CN) ..... 202010586241.4

(51) Int. Cl.
*E21B 34/14* (2006.01)
*E21B 33/129* (2006.01)

(52) U.S. Cl.
CPC ..... *E21B 34/142* (2020.05); *E21B 33/1294* (2013.01)

(58) Field of Classification Search
CPC ..... E21B 34/142; E21B 33/1294
See application file for complete search history.

(56) References Cited

U.S. PATENT DOCUMENTS

2009/0056934 A1* 3/2009 Xu ..... E21B 43/26 166/194
2019/0284899 A1* 9/2019 Tilley ..... E21B 33/143
2019/0330941 A1* 10/2019 Zhou ..... E21B 34/06
2020/0056449 A1* 2/2020 Stone ..... E21B 34/142

* cited by examiner

*Primary Examiner* — Christopher J Sebesta
(74) *Attorney, Agent, or Firm* — IPro, PLLC

(57) ABSTRACT

A switch sliding sleeve device for oil-gas exploitation and switching method thereof, an oil-gas exploitation tool and a switching method of a wall through hole thereof are disclosed. The disclosure relates to the technical field of oil-gas exploitation, and solves the technical problems in the prior art that the switching operation steps of a wall through hole of an outer cylinder are tedious and complex, and a large amount of manpower and material resources are consumed. The switch sliding sleeve device for oil-gas exploitation and the oil-gas exploitation tool include an outer cylinder, a switch sliding sleeve mechanism and a trigger. When the trigger is put into the outer cylinder and punching triggers the switch sliding sleeve mechanism, the switch sliding sleeve mechanism is capable of being switched from a state of opening the wall through hole to a state of closing the wall through hole until is triggered by the trigger or another trigger again. The switching method of the wall through hole of the oil-gas exploitation tool includes the following steps: putting a trigger into the outer cylinder to open the wall through hole, and putting the trigger into the outer cylinder again to close the wall through hole. Thus, the switching operation of the wall through hole is facilitated, and the operation cost is reduced.

19 Claims, 23 Drawing Sheets

SWITCH SLIDING SLEEVE DEVICE FOR OIL-GAS EXPLOITATION AND SWITCHING METHOD THEREOF, OIL-GAS EXPLOITATION TOOL AND SWITCHING METHOD OF WALL THROUGH HOLE THEREOF

CROSS REFERENCE TO RELATED APPLICATION

This application claims priority to Chinese Patent Application No. 201911102352.7 entitled SWITCH SLIDING SLEEVE DEVICE FOR OIL-GAS EXPLOITATION, OIL-GAS EXPLOITATION TOOL AND SWITCHING METHOD OF WALL THROUGH HOLE THEREOF and filed on Nov. 12, 2019, and Chinese Patent Application No. 202010586241.4 entitled SWITCH SLIDING SLEEVE DEVICE FOR OIL-GAS EXPLOITATION, OIL-GAS EXPLOITATION TOOL AND SWITCHING METHOD THEREOF and filed on Jun. 24, 2020, which are incorporated herein by reference in its entirety and for all purposes.

FIELD OF THE INVENTION

The disclosure relates to the technical field of oil-gas exploitation, in particular to a switch sliding sleeve device for oil-gas exploitation and a switching method thereof, an oil-gas exploitation tool provided with the switch sliding sleeve device for oil-gas exploitation and a switching method of a wall through hole of the oil-gas exploitation tool.

BACKGROUND OF THE INVENTION

In the process of oil and natural gas underground mining, it is necessary to cut off or connect the circulation of liquid by reciprocating motion. The switch sliding sleeve device for oil-gas exploitation is an important tool in the oil and natural gas underground mining process.

The currently existing switch sliding sleeve device for oil-gas exploitation includes an outer cylinder, a sliding sleeve and a ball for triggering, wherein the sliding sleeve is connected with the outer cylinder by a connecting pin; the wall of the outer cylinder is provided with a wall through hole capable of connecting the inner fluid channel of the outer cylinder with the outside of the outer cylinder. After the ball is put in, the ball will drop under the action of its self-weight. And when the ball is dropped onto the sliding sleeve, the ball will drive the sliding sleeve to pull off the connecting pin and move downward, thus close the wall through hole. When it is necessary to open the wall through hole, it is necessary to put in a special hooking tool to lift the pipe string, and pull up the sliding sleeve to no longer block (i.e. expose) the wall through hole. Many people need to cooperate in this operation.

Those skilled in the art find that the prior art has at least the following technical problems: At present, the ball putting method is commonly used in the prior art to control the opening or closing of downhole tools. However, the ball putting action cannot realize the switching between opening and closing. Therefore, putting balls and pressing must be combined with other methods, such as putting in tools, lifting pipe strings, etc., in order to control the switching actions of tools. In the operation process, many people need to cooperate, which consumes a lot of manpower and material resources. Therefore, it has become a difficulty puzzling the oil-gas fields production how to control the downhole fluid channel through mechanical tools.

SUMMARY OF THE INVENTION

At least one object of the disclosure is to provide a switch sliding sleeve device for oil-gas exploitation and switching method thereof, an oil-gas exploitation tool provided with the switch sliding sleeve device for oil-gas exploitation and a switching method of a wall through hole of the oil-gas exploitation tool, so as to solve the technical problems in the prior art that the switching operation steps of a wall through hole of an outer cylinder are tedious and complex, and consume a large amount of manpower and material resources.

The disclosure mainly involves two aspects, one is an identification structure for opening the sliding sleeve, and the other is a sliding sleeve capable of being opened and closed repeatedly. The switchable sliding sleeve can be opened or closed by the traditional ball, and can also be opened or closed by the identification structure of the disclosure.

To achieve the above purpose, the disclosure provides the following technical solutions.

According to one aspect of the disclosure, a switch sliding sleeve device for oil-gas exploitation is provided, which comprises an outer cylinder, a switch sliding sleeve mechanism and a trigger, wherein, a wall of the outer cylinder is provided with a wall through hole capable of connecting an internal fluid channel of the outer cylinder with outside of the outer cylinder, and the switch sliding sleeve mechanism is arranged inside the outer cylinder;

the extension direction of the axial line of the center hole of the switch sliding sleeve mechanism coincides with or is parallel to the extension direction of the axial line of the outer cylinder;

the switch sliding sleeve mechanism is capable of being switched from a state of opening the wall through hole to a state of closing the wall through hole when the trigger is put into the outer cylinder and punching triggers the switch sliding sleeve mechanism, and switching from the state of closing the wall through hole back to the state of opening the wall through hole until is triggered by the trigger or another trigger again; or, the switch sliding sleeve mechanism is capable of being switched from the state of closing the wall through hole to the state of opening the wall through hole when the trigger is put into the outer cylinder and punching triggers the switch sliding sleeve mechanism, and switching from the state of opening the wall through hole back to the state of closing the wall through hole until is triggered by the trigger or another trigger again.

Preferably or alternatively, the number of triggers is two or more, the trigger put into the outer cylinder for the first time is first trigger, the trigger or another trigger put into the outer cylinder again is second trigger, and the first trigger and/or the second trigger are made of soluble or degradable materials.

Preferably or alternatively, the first trigger and/or the second trigger is a sphere, ellipsoid, cylindrical structure or truncated cone structure.

Preferably or alternatively, the switch sliding sleeve mechanism comprises a sliding sleeve, a seat body and fluid medium, wherein, the seat body and the outer cylinder are connected with each other or are in an integral structure; a liquid-tight fluid medium accommodating chamber is formed among the sliding sleeve, the seat body and the outer cylinder; or, the switch sliding sleeve mechanism further comprises a liquid-tight retaining ring liquid-tightly connected to an inner side of the sliding sleeve, and a liquid-tight fluid medium accommodating chamber is formed among the sliding sleeve, the seat body, the outer cylinder and the liquid-tight retaining ring; the fluid medium is filled in the fluid medium accommodating chamber; the sliding sleeve comprises an inner sliding sleeve and an outer sliding sleeve sleeved outside the inner sliding sleeve, wherein, in the situation that a wall of the outer sliding sleeve is provided with a radial opening:

when one of the first trigger and the second trigger is put into the outer cylinder to punch an upstream end of one of the inner sliding sleeve and the outer sliding sleeve, the punched sliding sleeve of the inner sliding sleeve and the outer sliding sleeve moves downward and pushes the non-punched sliding sleeve of the inner sliding sleeve and the outer sliding sleeve to move upward through the fluid medium, so that the radial opening of the outer sliding sleeve and the wall through hole are staggered with each other, or the inner sliding sleeve blocks the wall through hole, and thus the wall through hole is closed, and when another one of the first trigger and the second trigger is put into the outer cylinder to punch another one of the inner sliding sleeve and the outer sliding sleeve, the punched sliding sleeve moves downward and pushes the non-punched sliding sleeve to move upward through the fluid medium, so that the radial opening of the outer sliding sleeve coincides with the wall through hole, and the inner sliding sleeve no longer blocks the radial opening of the outer sliding sleeve and the wall through hole, and thus the wall through hole is open;

or, in the situation that the wall of the outer sliding sleeve is provided with a radial opening:

when one of the first trigger and the second trigger is put into the outer cylinder to punch an upstream end of one of the inner sliding sleeve and the outer sliding sleeve, the punched sliding sleeve of the inner sliding sleeve and the outer sliding sleeve moves downward and pushes the non-punched sliding sleeve of the inner sliding sleeve and the outer sliding sleeve to move upward through the fluid medium, so that the radial opening of the outer sliding sleeve coincides with the wall through hole, the inner sliding sleeve no longer blocks the radial opening of the outer sliding sleeve and the wall through hole, and thus the wall through hole is open, and when another one of the first trigger and the second trigger is put into the outer cylinder to punch another one of the inner sliding sleeve and the outer sliding sleeve, the punched sliding sleeve moves downward and pushes the non-punched sliding sleeve to move upward through the fluid medium, so that the radial opening of the outer sliding sleeve and the wall through hole are staggered with each other, or the inner sliding sleeve blocks the wall through hole, and thus the wall through hole is closed;

or, in the situation that the wall of the outer sliding sleeve is not provided with a radial opening:

when one of the first trigger and the second trigger is put into the outer cylinder to punch an upstream end of the inner sliding sleeve, the inner sliding sleeve moves downward to close the wall through hole, and the inner sliding sleeve moving downward pushes the outer sliding sleeve to move upward through the fluid medium, and when another one of the first trigger and the second trigger is put into the outer cylinder to punch the outer sliding sleeve, the punched outer sliding sleeve moves downward and pushes the non-punched inner sliding sleeve to move upward through the fluid medium, so that the inner sliding sleeve no longer blocks the wall through hole, and thus the wall through hole is open.

Preferably or alternatively, the upstream end of the outer sliding sleeve has a larger port size than the upstream end of the inner sliding sleeve has, the first trigger and the second trigger are both spheres, and the diameter of the first trigger is different from that of the second trigger; or, one of the first trigger and the second trigger only matches with the shape of the outer sliding sleeve and is only capable of driving the matched outer sliding sleeve downward, and the other one of the first trigger and the second trigger only matches with the shape of the inner sliding sleeve and is only capable of driving the matched inner sliding sleeve downward.

Preferably or alternatively, the first trigger has an outer wall provided with a first triggering structure, and the outer sliding sleeve is provided with a first identification structure corresponding to the first triggering structure; the second trigger has an outer wall provided with a second triggering structure, and the inner sliding sleeve is provided with a second identification structure corresponding to the second triggering structure;

when the first trigger is put in, and the first trigger moves forward along a direction from well head to well bottom and reaches the first identification structure of the outer sliding sleeve, the first triggering structure is capable of identifying and connecting with the first identification structure, driving the outer sliding sleeve to move forward along the direction from well head to well bottom and opening the wall through hole previously closed by the outer sliding sleeve, and the outer sliding sleeve moving downward pushes the inner sliding sleeve to move upward through the fluid medium;

when the second trigger is put in, and the second trigger moves forward along the direction from well head to well bottom and reaches the inner sliding sleeve, the second triggering structure is capable of identifying and connecting with the second identification structure, driving the inner sliding sleeve to move forward along the direction from well head to well bottom and pushing the outer sliding sleeve to move upward through the fluid medium to close the wall through hole;

the inner diameter size of the second identification structure is the same as that of the first identification structure, and the cross-sectional shapes of the second identification structure and the first identification structure are different.

Preferably or alternatively, the fluid medium is hydraulic oil, water or particles with fluidity.

Preferably or alternatively, the upstream ends of the inner sliding sleeve and the outer sliding sleeve are respectively provided with conical inner surfaces or are respectively fixedly connected with ball seats provided with conical inner surfaces, and the inner diameter size of the conical inner surfaces gradually reduces along a direction from upstream to downstream.

Preferably or alternatively, the outer sliding sleeve is provided with a stop flange, and when the outer sliding sleeve moves downward to a position of closing the wall through hole, the stop flange abuts against the upstream end of the inner sliding sleeve.

Preferably or alternatively, the wall of the inner sliding sleeve is provided with an inner wall opening, the wall through hole is in an open state when the radial opening of the outer sliding sleeve, the inner wall opening of the inner sliding sleeve and the wall through hole coincide, and the wall through hole is in a closed state when the radial opening of the outer sliding sleeve, the inner wall opening of the inner sliding sleeve and the wall through hole are staggered;

or, the wall through hole is in an open state when the radial opening of the outer sliding sleeve and the wall through hole coincide and are not blocked by the inner sliding sleeve, and the wall through hole is in a closed state when the radial opening of the outer sliding sleeve and the wall through hole are staggered or one of the radial opening of the outer sliding sleeve and the wall through hole is blocked by the inner sliding sleeve.

Preferably or alternatively, the device is applied in an oil-gas well and comprises an outer cylinder, a trigger and a sliding sleeve, wherein, an inner cavity of the outer cylinder forms an internal fluid channel, and a sidewall of the outer cylinder is provided with a wall through hole; the sliding sleeve comprises a rear-stage sliding sleeve and a preceding-stage sliding sleeve which are slidably or detachably connected to the outer cylinder; the trigger comprises a preceding-stage trigger and a rear-stage trigger, the preceding-stage trigger has an outer wall provided with a preceding-stage triggering structure, and the preceding-stage sliding sleeve has an inner wall provided with a preceding-stage identification structure corresponding to the preceding-stage triggering structure; the rear-stage trigger has an outer wall provided with a rear-stage triggering structure, and the rear-stage sliding sleeve has an inner wall provided with a rear-stage identification structure corresponding to the rear-stage triggering structure; the preceding-stage sliding sleeve is located closer to the well bottom than the rear-stage sliding sleeve is;

when the preceding-stage trigger is put in, and the preceding-stage trigger moves forward along a direction from well head to well bottom, passes through the rear-stage identification structure of the rear-stage sliding sleeve, and reaches the preceding-stage sliding sleeve, the preceding-stage triggering structure is capable of identifying and connecting with the preceding-stage identification structure, driving the preceding-stage sliding sleeve to move forward along the direction from well head to well bottom and open the wall through hole previously closed by the preceding-stage sliding sleeve;

when the rear-stage trigger is put in, and the rear-stage trigger moves forward along the direction from well head to well bottom and reaches the rear-stage sliding sleeve, the rear-stage triggering structure is capable of identifying and connecting with the rear-stage identification structure, driving the rear-stage sliding sleeve to move forward along the direction from well head to well bottom and open the wall through hole previously closed by the rear-stage sliding sleeve;

the inner diameter size of the rear-stage recognition structure is the same as that of the preceding-stage recognition structure, and the cross-sectional shapes of the rear-stage recognition structure and the preceding-stage recognition structure are different.

Preferably or alternatively, the number of the rear-stage sliding sleeve or the preceding-stage sliding sleeve is one, two, three or more, wherein, the preceding-stage triggering structure and the rear-stage triggering structure are formed by sidewalls of grooves with different width sizes, and the rear-stage recognition structure and the preceding-stage recognition structure are protrusions with different sizes.

Or, the preceding-stage triggering structure and the rear-stage triggering structure are protrusions with different sizes, and the rear-stage recognition structure and the preceding-stage recognition structure are formed by sidewalls of grooves with different width sizes.

Or, the preceding-stage triggering structure and the rear-stage triggering structure are formed by sidewalls of different numbers of grooves, and the rear-stage identification structure and the preceding-stage identification structure are different numbers of protrusions.

Or, the preceding-stage triggering structure and the rear-stage triggering structure are different numbers of protrusions, and the rear-stage recognition structure and the preceding-stage recognition structure are formed by sidewalls of different numbers of grooves.

Preferably or alternatively, the length direction of the protrusion extends along the axial direction of the device, and the shape of the axial section of the protrusion is oblong, oval or round.

Preferably or alternatively, the preceding-stage triggering structure and the rear-stage triggering structure are both formed by sidewalls of grooves, and each of the preceding-stage trigger and the rear-stage trigger comprises a blocking body, an outer boss and the groove, wherein the blocking body comprises a conical lower part and a cylindrical upper part, the outer boss is fixedly arranged on an outer wall of the upper part of the blocking body, and the outer diameter size of the outer boss is larger than the maximum outer diameter size of the blocking body; and the groove runs through the outer boss along the axial direction.

Preferably or alternatively, the width direction of the groove is parallel to the circumferential direction of the outer cylinder, and the width size of the groove gradually reduces along the direction from the well bottom to the well head, wherein, the width size of the narrowest section of the groove is 1/20 to 1/5 of the outer diameter size of the outer boss; and/or, the width size of the widest section of the protrusion is 1/20 to 1/5 of the inner diameter size of the outer cylinder; and/or the radial size of the protrusion is 1/40 to 1/5 of the inner diameter size of the outer cylinder.

Preferably or alternatively, the groove has a sidewall formed by smooth transition between a curved surface and a flat surface; and/or, the grooves on the outer wall of the preceding-stage trigger and the grooves on the outer wall of the rear-stage trigger are of the same number but of different width sizes, or are of different numbers but of the same width size.

Preferably or alternatively, the grooves on the outer wall of the preceding-stage trigger, the grooves on the outer wall of the rear-stage trigger, the protrusions on the inner wall of the rear-stage sliding sleeve and the protrusions on the inner wall of the preceding-stage sliding sleeve are all of the same number, and a plurality of said grooves are evenly distributed on the outer wall of the rear-stage trigger or the preceding-stage trigger along the circumferential direction, and a plurality of said protrusions are evenly distributed on the inner wall of the rear-stage sliding sleeve or the preceding-stage sliding sleeve along the circumferential direction.

Preferably or alternatively, the rear-stage identification structure is arranged at an upper or middle part of the rear-stage sliding sleeve, and the preceding-stage identification structure is arranged at an upper or middle part of the preceding-stage sliding sleeve.

Preferably or alternatively, the part of the rear-stage sliding sleeve excluding the rear-stage identification structure and the part of the preceding-stage sliding sleeve excluding the preceding-stage identification structure have inner walls with coincident projections in the direction from well head to well bottom, and the preceding-stage triggering structure and the rear-stage triggering structure have the same outer diameter size, when the preceding-stage trigger and the rear-stage trigger are put into the outer cylinder, they move forward along the direction from well head to well bottom under the action of self-weight or external thrust.

Preferably or alternatively, among the outer cylinder, the preceding-stage trigger, the rear-stage trigger and the sliding sleeve, at least the preceding-stage trigger and the rear-stage trigger are made of soluble or degradable materials.

Preferably or alternatively, the respective axial sections of the outer cylinder have inner walls with the same inner diameter, the respective axial sections of the part of the rear-stage sliding sleeve excluding the rear-stage identification structure and the part of the preceding-stage sliding sleeve excluding the preceding-stage identification structure have inner walls with the same inner diameter, and the respective axial sections of the part of the preceding-stage trigger excluding the preceding-stage triggering structure and the part of the rear-stage trigger excluding the rear-stage trigging structure have outer walls with the same outer diameter.

Preferably or alternatively, when the preceding-stage sliding sleeve moves forward along the direction from well head to well bottom and opens the wall through hole previously closed by the preceding-stage sliding sleeve, the preceding-stage trigger provided with the preceding-stage triggering structure sets and closes the inner channel of the preceding-stage sliding sleeve; when the rear-stage sliding sleeve moves forward along the direction from well head to well bottom and opens the wall through hole previously closed by the rear-stage sliding sleeve, the rear-stage trigger provided with the rear-stage triggering structure sets and closes the inner channel of the rear-stage sliding sleeve.

Preferably or alternatively, the outer cylinder comprises a cylinder body, an upper joint, a lower joint, a nozzle wall plate and a sealing ring, wherein, the upper joint is detachably connected with an upper end of the cylinder body, and the lower joint is detachably connected with an lower end of the cylinder body; when the sliding sleeve opens the wall through hole, the bottom end of the sliding sleeve abuts against the lower joint; the preceding-stage trigger is embedded in the preceding-stage sliding sleeve or the rear-stage trigger is embedded in the rear-stage sliding sleeve; the nozzle wall plate is arranged on an opening of the wall of the cylinder body, the wall through hole is formed by a through hole provided on the nozzle wall plate, the sealing ring is interposed among the nozzle wall plate, a wall of the cylinder body and the sliding sleeve at a position of closing the wall through hole, and the sliding sleeve temporarily stays at the position of closing the wall through hole under friction of the sealing ring until the trigger drives the sliding sleeve to move forward and open the wall through hole previously closed by the sliding sleeve.

According to one aspect of the disclosure, a switching method of a switch sliding sleeve device for oil-gas exploitation is provided. The switching method comprising: putting the preceding-stage trigger into the outer cylinder, and when the preceding-stage trigger moves forward along the direction from well head to well bottom, passes through the rear-stage identification structure of the rear-stage sliding sleeve and reaches the preceding-stage sliding sleeve, the preceding-stage triggering structure identifying and connecting with the preceding-stage identification structure and driving the preceding-stage sliding sleeve to move forward along the direction from well head to well bottom and open the wall through hole previously closed by the preceding-stage sliding sleeve; and putting the rear-stage trigger into the outer cylinder, and when the rear-stage trigger moves forward along the direction from well head to well bottom and reaches the rear-stage sliding sleeve, the rear-stage triggering structure identifying and connecting with the rear-stage identification structure and driving the rear-stage sliding sleeve to move forward along the direction from well head to well bottom and open the wall through hole previously closed by the rear-stage sliding sleeve, or, the switching method comprising: putting the rear-stage trigger into the outer cylinder, and when the rear-stage trigger moves forward along the direction from well head to well bottom and reaches the rear-stage sliding sleeve, the rear-stage triggering structure identifying and connecting with the rear-stage identification structure and driving the rear-stage sliding sleeve to move forward along the direction from well head to well bottom and open the wall through hole previously closed by the rear-stage sliding sleeve; and after the rear-stage trigger made of soluble or degradable material is dissolved or degraded, putting the preceding-stage trigger into the outer cylinder, and when the preceding-stage trigger moves forward along the direction from well head to well bottom, passes through the rear-stage identification structure of the rear-stage sliding sleeve and reaches the preceding-stage sliding sleeve, the preceding-stage triggering structure identifying and connecting with the preceding-stage identification structure and driving the preceding-stage sliding sleeve to move forward along the direction from well head to well bottom and open the wall through hole previously closed by the preceding-stage sliding sleeve.

According to one aspect of the disclosure, an oil-gas exploitation tool is provided which comprises the above-mentioned switch sliding sleeve device for oil-gas exploitation.

Preferably or alternatively, the oil-gas exploitation tool is a sliding sleeve tool or a packer, wherein, the packer includes a rubber cylinder and a fluid channel, when the wall through hole is in an open state, the fluid in the internal fluid channel of the outer cylinder is capable of sequentially flowing through the wall through hole and the fluid channel to push the rubber cylinder to deform and set in a casing or oil-gas well where the packer is located; when the wall through hole is in a closed state, the fluid in the fluid channel is capable of keeping the rubber cylinder deforming and setting in the casing or oil-gas well where the packer is located; when the wall through hole is in a open state again, the fluid in the fluid channel flows through the fluid channel and the wall through hole and into the internal fluid channel of the outer cylinder to restore the shape of the rubber cylinder before setting and release setting.

Preferably or alternatively, the switching method comprising: putting a trigger into the outer cylinder of the switch sliding sleeve device for oil-gas exploitation according to claim 1, the switch sliding sleeve mechanism is capable of being switched from the state of opening the wall through hole to the state of closing the wall through hole when the trigger is put into the outer cylinder and punching triggers the switch sliding sleeve mechanism; and putting the trigger or another trigger into the outer cylinder again, and the switch sliding sleeve mechanism is capable of being switched from the state of closing the wall through hole to the state of opening the wall through hole when the switch sliding sleeve mechanism is triggered by the trigger or another trigger again.

Or, the switching method comprising: putting a trigger into the outer cylinder of the switch sliding sleeve device for oil-gas exploitation according to claim 1, the switch sliding sleeve mechanism is capable of being switched from the state of closing the wall through hole to the state of opening the wall through hole when the trigger is put into the outer cylinder and punching triggers the switch sliding sleeve mechanism; and putting the trigger or another trigger into the outer cylinder again, and the switch sliding sleeve mechanism is capable of being switched from the state of opening the wall through hole to the state of closing the wall through hole when the switch sliding sleeve mechanism is triggered by the trigger or another trigger again.

Any technical solution of the disclosure can at least produce the following technical effects: in the switch sliding sleeve device for oil-gas exploitation provided by the disclosure, when the trigger is put into the outer cylinder and punching triggers the switch sliding sleeve mechanism, the switch sliding sleeve mechanism is capable of being switched from the state of opening the wall through hole to the state of closing the wall through hole until is triggered by the trigger or another trigger again, and then switches from the state of closing the wall through hole back to the state of opening the wall through hole; or, when the trigger is put into the outer cylinder and punching triggers the switch sliding sleeve mechanism, the switch sliding sleeve mechanism is capable of being switched from the state of closing the wall through hole to the state of opening the wall through hole until is triggered by the trigger or another trigger again, and then switches from the state of opening the wall through hole to the state of closing the wall through hole. Thus, the opening and closing state of the wall through hole on the outer cylinder can be switched by putting in two triggers or putting in a trigger twice. The tedious and complex prior art operations of dropping a special hooking tool to lift the pipe string and pulling up the sliding sleeve are omitted. Collaborative work of multiple people is no longer necessary. And the cost of the special hooking tool is also saved. Therefore, the technical problems that the switching operation steps of the wall through hole of the outer cylinder are tedious and complex and a large amount of manpower and material resources are consumed in the prior art are solved.

BRIEF DESCRIPTION OF THE DRAWINGS

In order to explain the embodiments of the disclosure or the technical solution in the prior art more clearly, the drawings required in describing the embodiments or the prior art will be briefly introduced below. Obviously, the drawings in the following description are only some embodiments of the disclosure, and other drawings can be obtained according to these drawings by those of ordinary skill in the art without paying creative labor.

FIG. 13 is another schematic sectional view of the rear-stage sliding sleeve shown in

FIG. 12.

Figure 1:
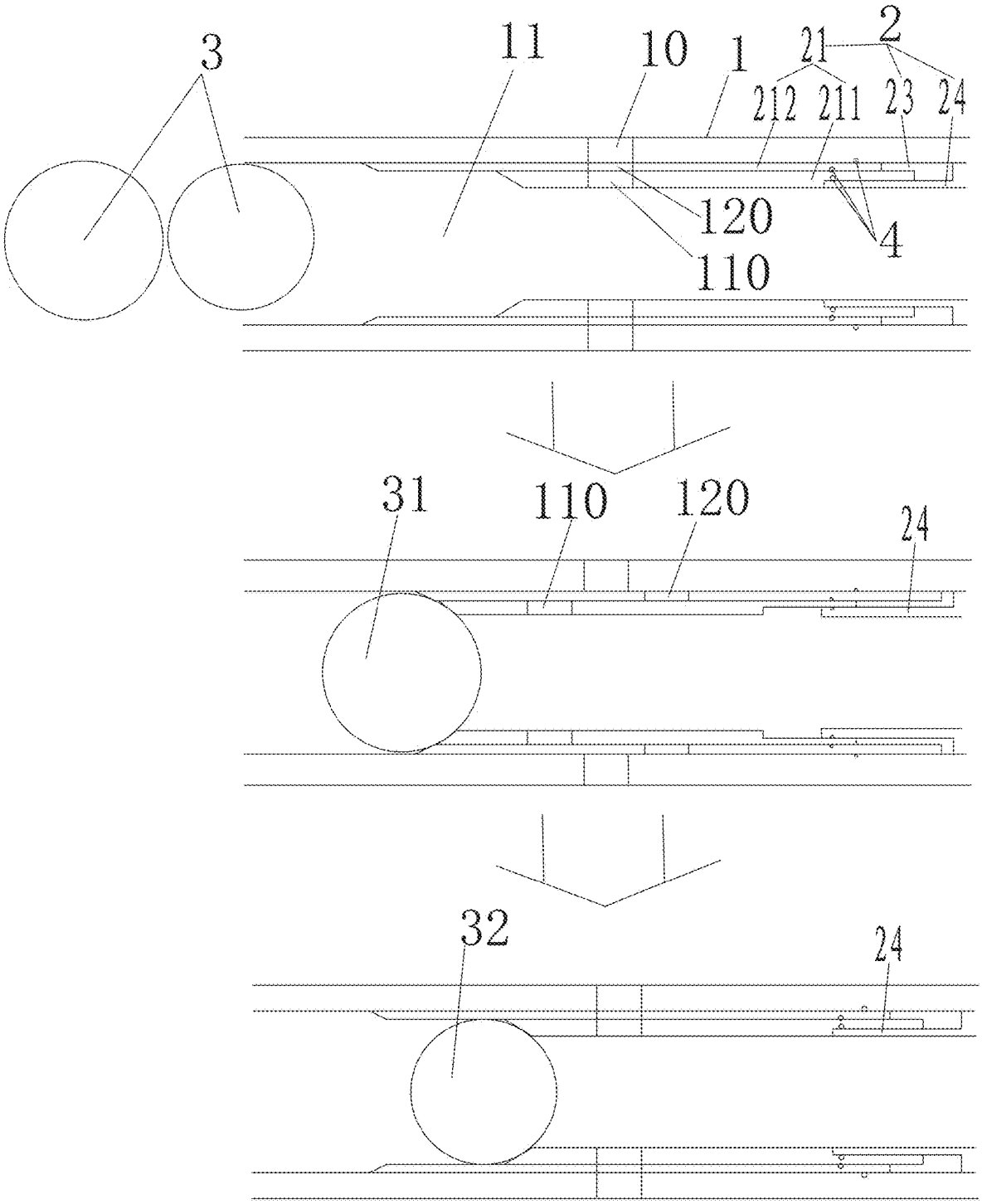
FIG. 1 is a schematic diagram of the switching process of a switch sliding sleeve device for oil-gas exploitation provided by an embodiment of the disclosure.

Reference numbers in the figures: 1. outer cylinder; 10. wall through hole; 11. internal fluid channel; 2. switch sliding sleeve mechanism; 21. sliding sleeve; 211. inner sliding sleeve; 110. inner wall opening; 212. outer sliding sleeve; 120. radial opening; 22. seat body; 23. fluid medium; 231. fluid medium accommodating cavity; 24. Liquid-tight retaining ring; 3. trigger; 31. first trigger; 32. second trigger; 4. sealing ring; 5. rubber cylinder; 6. fluid channel (the fluid can be fracturing fluid); 71. outer tube body; 72. inner tube body; 8. fluid exit and entrance; 200. well bottom; 201. first stage sliding sleeve; 202. second stage sliding sleeve; 203. third stage sliding sleeve; 20*n*. the N-th sliding sleeve; 204. ground (setting well head); 21*a*. rear-stage sliding sleeve; a1. rear-stage recognition structure; 21*b*. preceding-stage sliding sleeve; a2. preceding-stage identification structure; 31*a*. pre-trigger; 311. preceding-stage triggering structure; 32*a*. rear-stage trigger; 321. rear-stage triggering structure; 301. blocking body; 302. outer boss; 303. groove; 304. curved surface; 305. flat surface; 12. cylinder body; 13. lower joint; 14. upper joint; 15. nozzle wall plate; R. inner diameter.

DETAILED DESCRIPTION OF THE EMBODIMENTS

In order to make the objective, technical solution and advantages of the disclosure clearer, the technical solution of the disclosure will be described in detail with reference to FIGS. 1-31. Obviously, the described embodiments are only some embodiments of the disclosure, not all embodiments. Based on the embodiments of the disclosure, all other embodiments obtained by those of ordinary skill in the art without paying creative labor belong to the protection scope of the disclosure.

The disclosure provides a switch sliding sleeve device for oil-gas exploitation, an oil-gas exploitation tool provided with the switch sliding sleeve device for oil-gas exploitation and a switching method of a wall through hole of the oil-gas exploitation tool, with simple and convenient switching operation steps of the wall through hole of the outer cylinder and low labor and material cost.

As shown in FIG. 1-8, the switch sliding sleeve device for oil-gas exploitation provided by the disclosure includes an outer cylinder 1, a switch sliding sleeve mechanism 2 and a trigger 3.

The wall of the outer cylinder 1 is provided with a wall through hole 10 capable of connecting the internal fluid channel 11 of the outer cylinder 1 with the outside of the outer cylinder 1, and the switch sliding sleeve mechanism 2 is arranged inside the outer cylinder 1.

The extension direction of the axial line of the center hole of the switch sliding sleeve mechanism 2 coincides with or is parallel to the extension direction of the axial line of the outer cylinder 1.

When the trigger 3 is put into the outer cylinder 1 and punching triggers the switch sliding sleeve mechanism 2, the switch sliding sleeve mechanism 2 is capable of being switched from a state of opening the wall through hole 10 to a state of closing the wall through hole 10 until is triggered by the trigger 3 or another trigger 3 again, and then is capable of being switched from a state of closing the wall through hole 10 to a state of opening the wall through hole 10.

Or, when the trigger 3 is put into the outer cylinder 1 and punching triggers the switch sliding sleeve mechanism 2, the switch sliding sleeve mechanism 2 is capable of being switched from the state of closing the wall through hole 10 to the state of opening the wall through hole 10 until is triggered by the trigger 3 or another trigger 3 again, and then is capable of being switched from a state of opening the wall through hole 10 to a state of closing the wall through hole 10.

According to the disclosure, the opening and closing states of the wall through hole 10 of the outer cylinder 1 can be switched only by putting two triggers 3 or putting the trigger 3 twice. Thus, the tedious and complicated operation of dropping the special hooking tool to lift the pipe string and pull up the sliding sleeve 21 in the prior art is omitted, collaborative work of multiple people is no longer necessary, and the cost of the special hooking tool is saved.

As a preferred or alternative embodiment, the number of triggers 3 is two or more, wherein the trigger 3 put into the outer cylinder for the first time is the first trigger 31, the trigger 3 delivered again or another trigger 3 put into the outer cylinder again is the second trigger 32. And the first trigger 31 and/or the second trigger 32 are made of soluble or degradable materials. The first trigger 31 and the second trigger 32 are preferably made of materials that are soluble or degradable in water.

As a preferred or alternative embodiment, the first trigger 31 and/or the second trigger 32 is a sphere, ellipsoid, cylindrical structure or truncated cone structure. The first trigger 31 and the second trigger 32 are preferably spheres, because the spheres are convenient to put in and dissolve and degrade quickly.

As a preferred or optional embodiment, the switch sliding sleeve mechanism 2 includes a sliding sleeve 21, a seat body 22 and a fluid medium 23, wherein the seat body 22 and the outer cylinder 1 are connected with each other or are in an integral structure. A liquid-tight fluid medium accommodating chamber is formed among the sliding sleeve 21, the seat body 22 and the outer cylinder 1. Or, the switching sliding sleeve mechanism 2 further includes a liquid-tight retaining ring 24 liquid-tightly connected (through a sealing ring) to the inner side of the sliding sleeve, and a liquid-tight fluid medium accommodating chamber is formed among the sliding sleeve 21, the seat body 22, the outer cylinder 1 and the liquid-tight retaining ring 24.

The fluid medium 23 is filled in the fluid medium accommodating chamber

The sliding sleeve 21 includes an inner sliding sleeve 211 (or inner sleeve) and an outer sliding sleeve 212 (or outer sleeve). In the situation that the wall of the outer sliding sleeve 212 is provided with a radial opening 120, as shown in FIGS. 1-6, when the first trigger 31 is put into the outer cylinder 1 and punches the upstream end of one of the inner sliding sleeve 211 and the outer sliding sleeve 212 (the outer sliding sleeve 212 in FIGS. 1, 2 and 4, and the inner sliding sleeve 211 in FIG. 3), the punched sliding sleeve 21 in the inner sliding sleeve 211 and the outer sliding sleeve 212 (the outer sliding sleeve 21 in FIGS. 1, 2 and 4, and the inner sliding sleeve 211 in FIG. 3) moves downward and pushes the non-punched sliding sleeve 21 (the inner sliding sleeve 211 in FIGS. 1, 2 and 4 and the outer sliding sleeve 212 in FIG. 3) of the two to move upward through the fluid medium, so that the radial opening 120 of the outer sliding sleeve 212 and the wall through hole 10 are staggered with each other, or the inner sliding sleeve 211 blocks the wall through hole 10, and thus the wall through hole is closed.

When the second trigger 32 is put into the outer cylinder 1 and punches the other one of the inner sliding sleeve 211 and the outer sliding sleeve 212 (the inner sliding sleeve 211 in FIGS. 1, 2 and 4, and the outer sliding sleeve 212 in FIG. 3), the punched sliding sleeve 21 (the inner sliding sleeve 211 in FIGS. 1, 2 and 4 and the outer sliding sleeve 212 in FIG. 3) moves downward and pushes the non-punched sliding sleeve 21 (the outer sliding sleeve 212 in FIGS. 1, 2 and 4 and the inner sliding sleeve 211 in FIG. 3) to move upward through the fluid medium, so that the radial opening 120 of the outer sliding sleeve 212 coincides with and the wall through hole 10, and the inner sliding sleeve 211 no longer blocks (i.e., exposes) the radial opening 120 of the outer sliding sleeve 212 and the wall through hole 10, and thus the wall through hole is open.

As a preferred or alternative embodiment, in the situation the wall of the outer sliding sleeve is provided with a radial opening, when one of the first trigger and the second trigger is put into the outer cylinder to punch an upstream end of one of the inner sliding sleeve and the outer sliding sleeve, the punched sliding sleeve of the inner sliding sleeve and the outer sliding sleeve moves downward and pushes the non-punched sliding sleeve of the two to move upward through the fluid medium, so that the radial opening of the outer sliding sleeve coincides with the wall through hole, the inner sliding sleeve no longer blocks (i.e., exposes) the radial opening of the outer sliding sleeve and wall through hole, and thus the wall through hole is open.

When the other one of the first trigger and the second trigger is put into the outer cylinder to punch the other one of the inner sliding sleeve and the outer sliding sleeve, the punched sliding sleeve moves downward and pushes the non-punched sliding sleeve to move upward through the fluid medium, so that the radial opening of the outer sliding sleeve and the wall through hole are staggered with each other, or the inner sliding sleeve blocks the wall through hole, and thus the wall through hole is closed.

Figure 5:
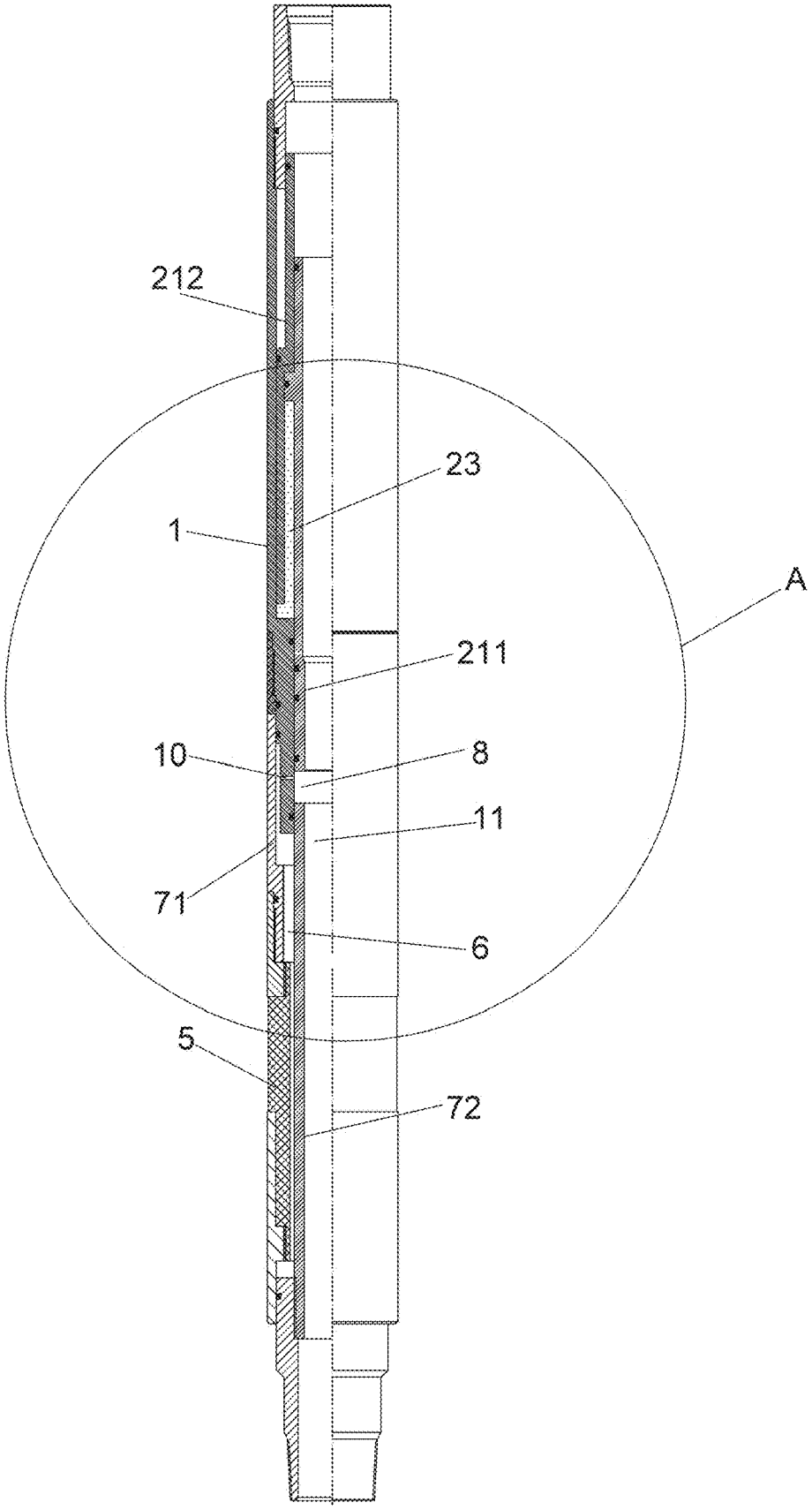
FIG. 5 is a schematic diagram of a packer applied by a switch sliding sleeve device for oil-gas exploitation provided by an embodiment of the disclosure.
Figure 6:
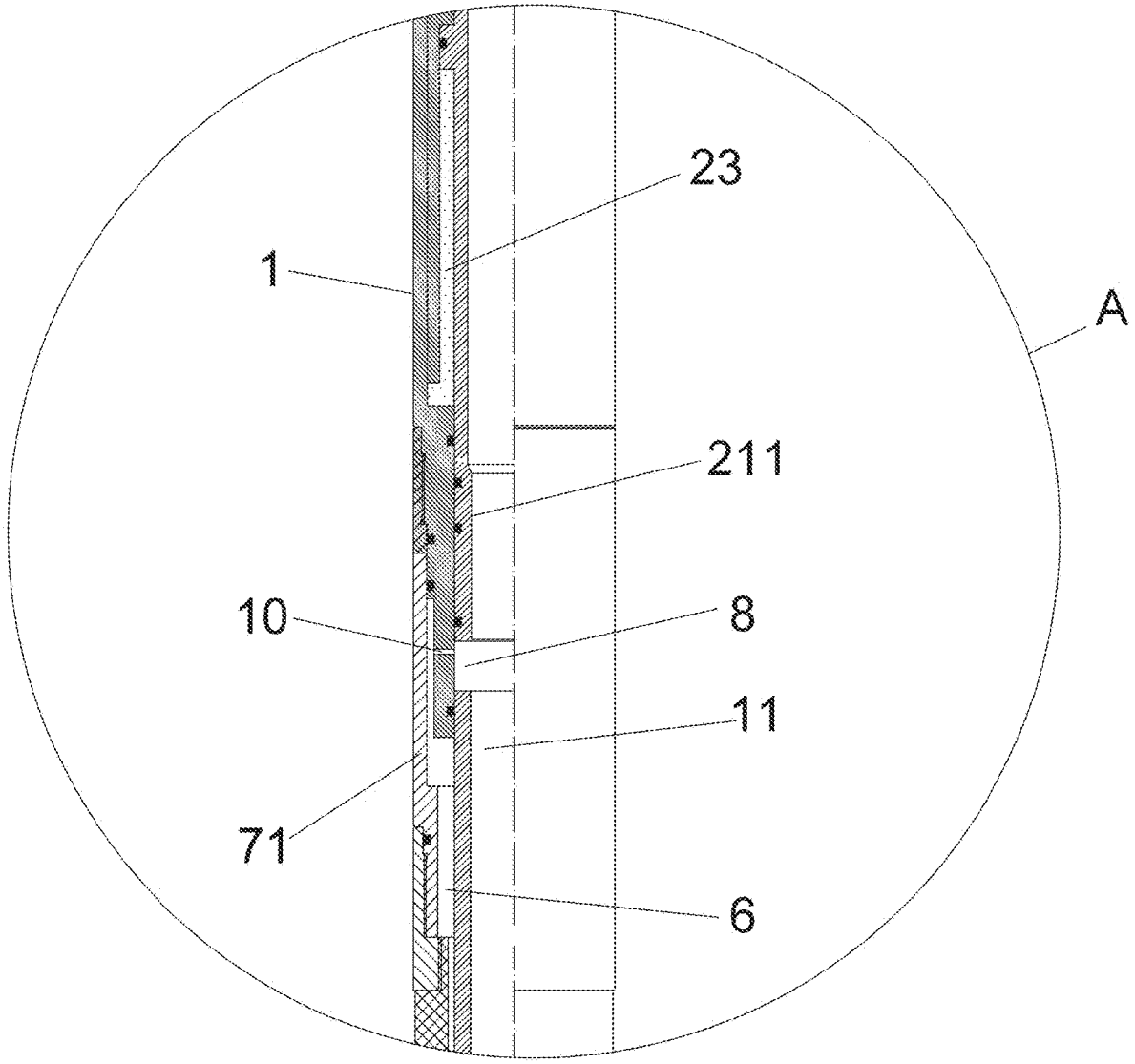
FIG. 6 is an enlarged schematic diagram of part A in FIG. 5.
Figure 7:
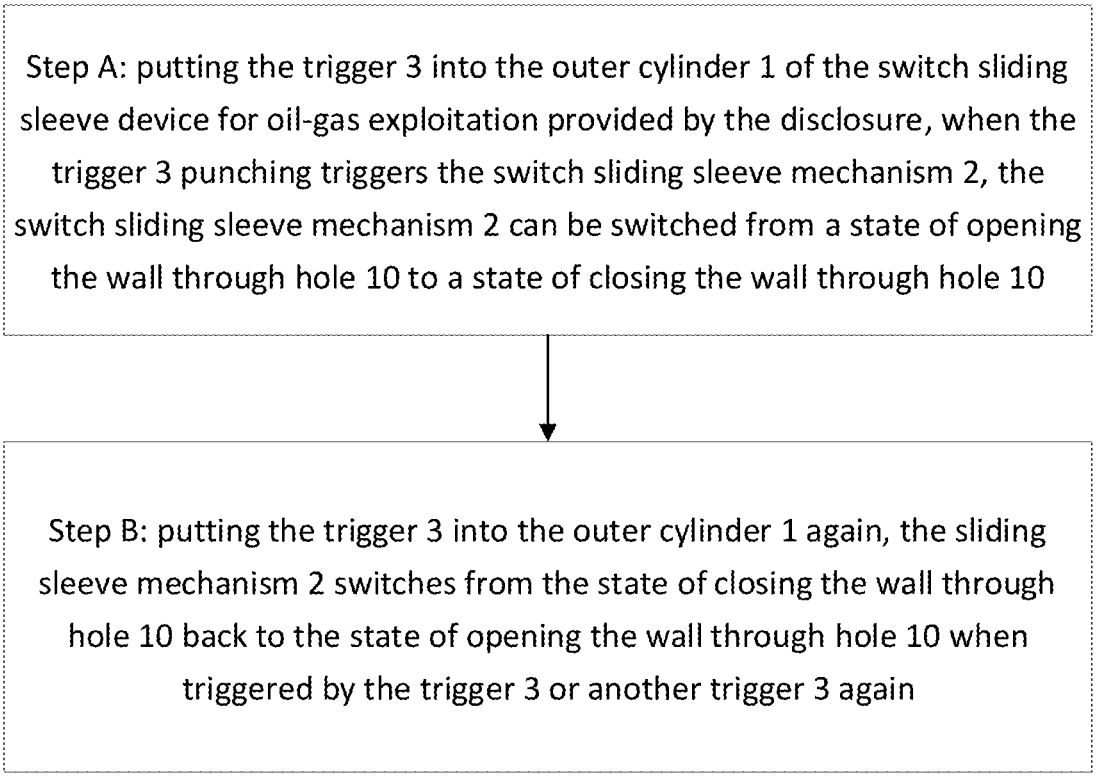
FIG. 7 is a schematic flow chart of a switching method of a wall through hole of an oil-gas exploitation tool provided by an embodiment of the disclosure.
Figure 8:
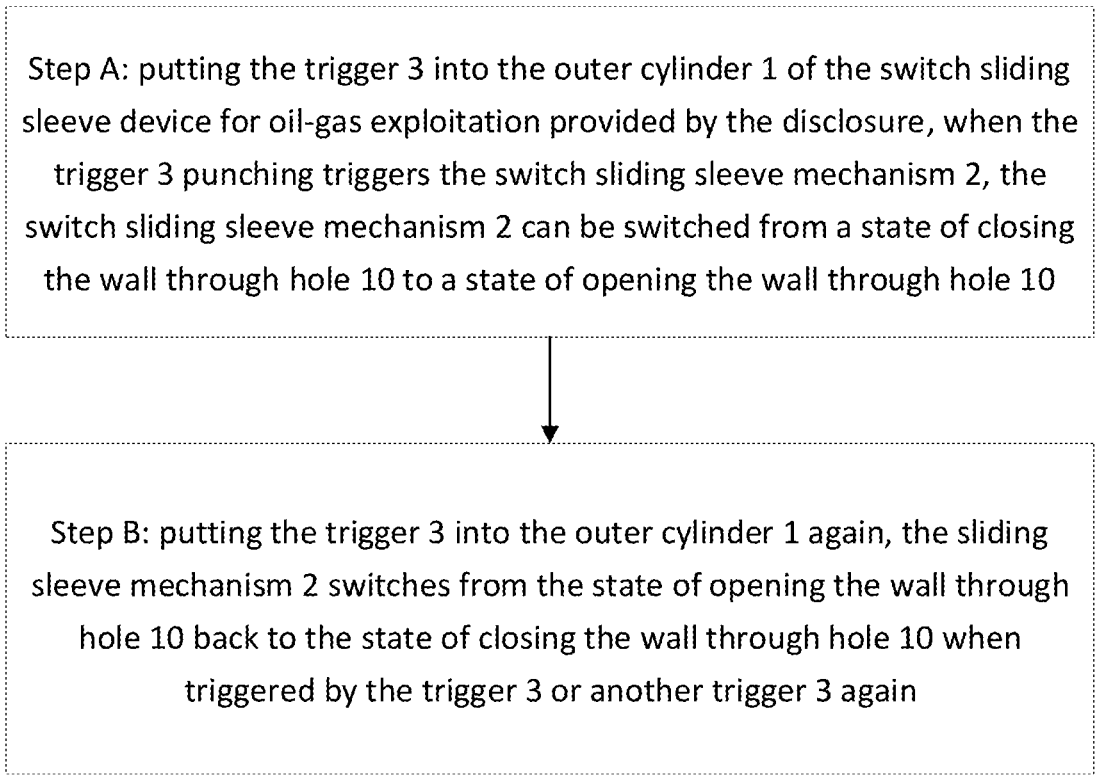
FIG. 8 is a schematic flow chart of switching method of the wall through hole of another oil-gas exploitation tool provided by the embodiment of the disclosure.
Figure 9:
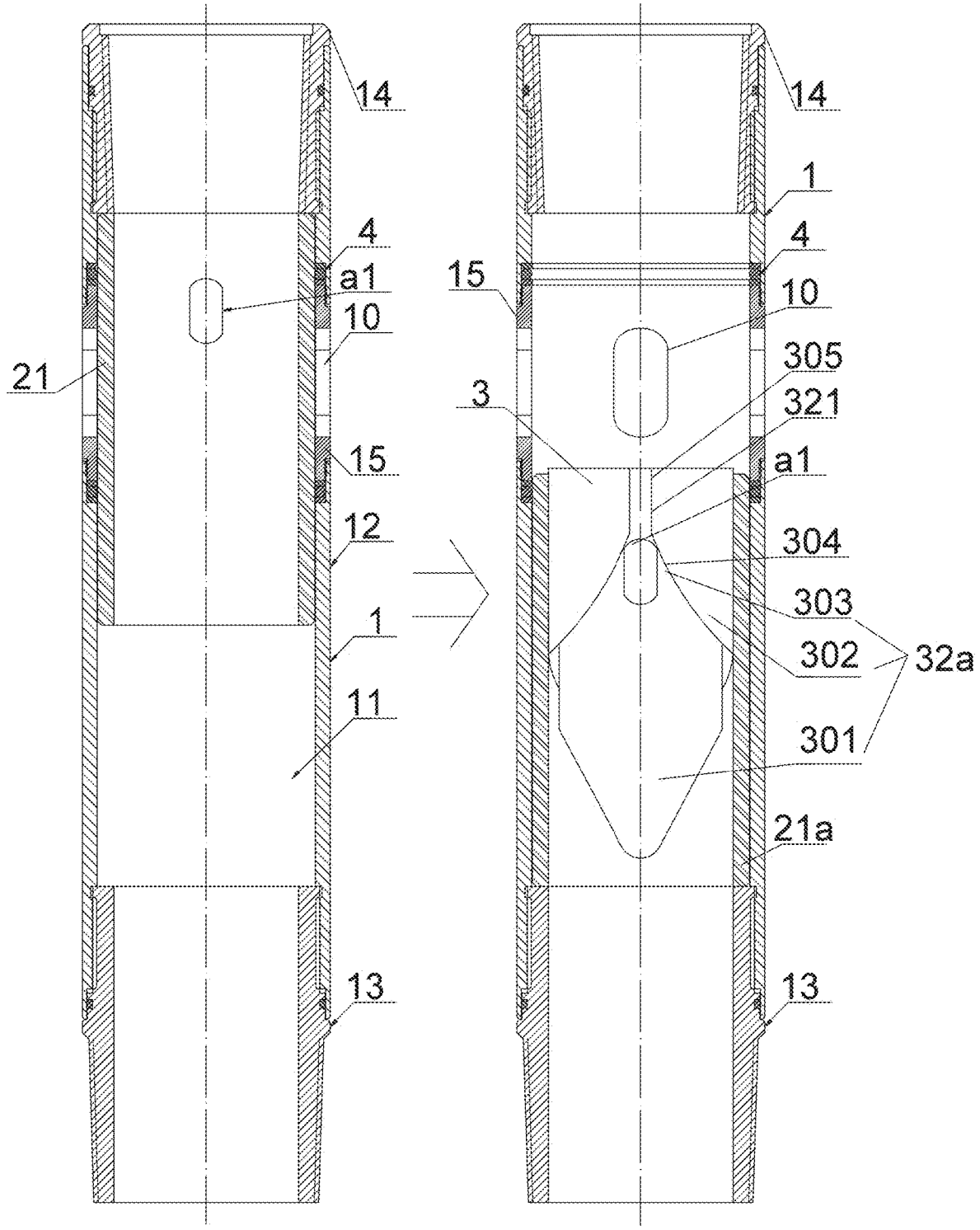
FIG. 9 is a schematic diagram of the process of a rear-stage trigger driving a sliding sleeve to open the wall through hole when the rear-stage trigger is put into the switch sliding sleeve device for oil-gas exploitation provided by the disclosure.
Figure 10:
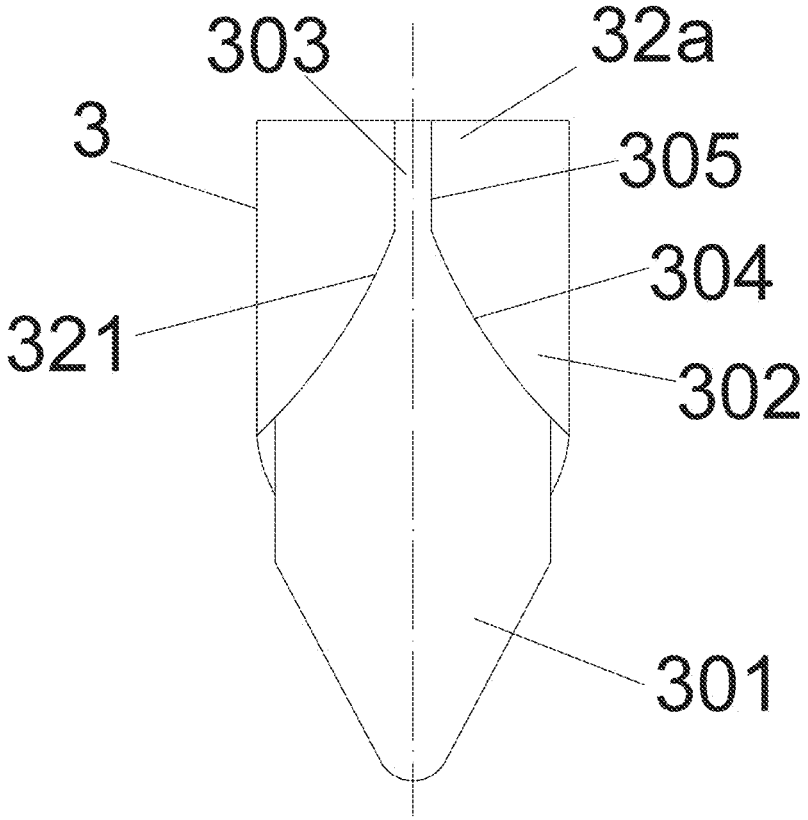
FIG. 10 is a schematic front view of a rear-stage trigger provided by the disclosure.
Figure 11:
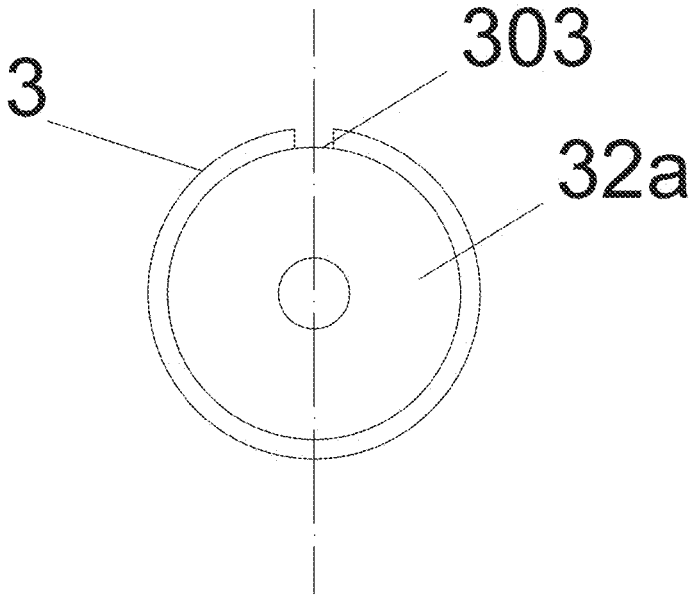
FIG. 11 is a schematic bottom view of the rear-stage trigger shown in FIG. 10.
Figure 12:
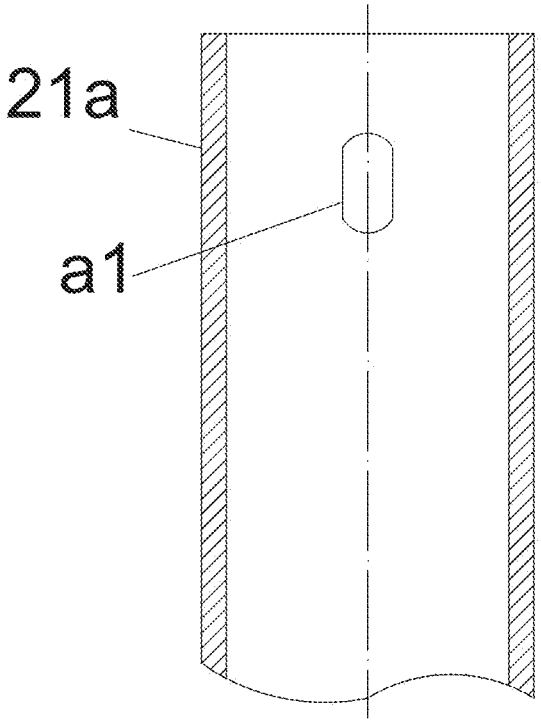
FIG. 12 is a schematic sectional view of a rear-stage sliding sleeve provided by the disclosure.
Figure 13:
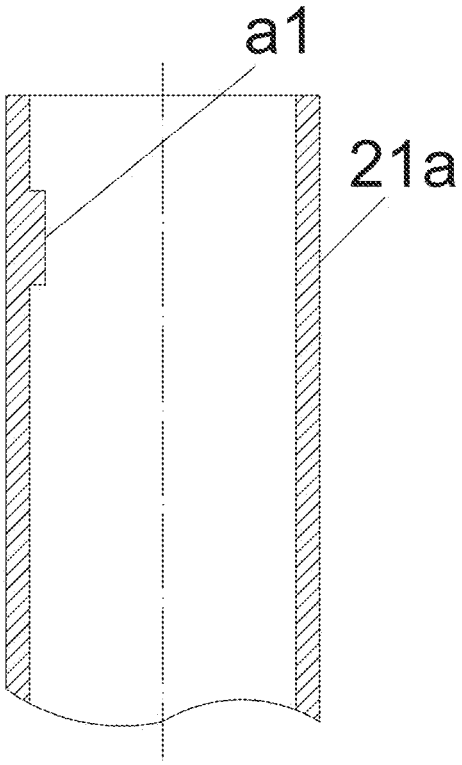
Figure 14:
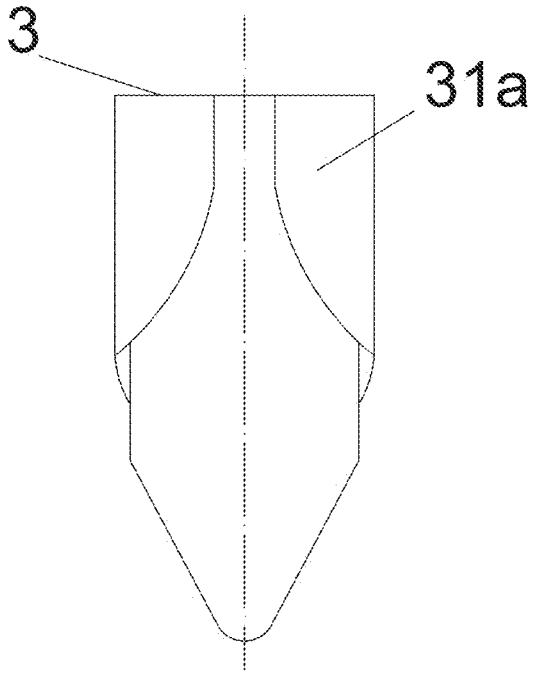
FIG. 14 is a schematic front view of a preceding-stage trigger provided by the disclosure.
Figure 15:
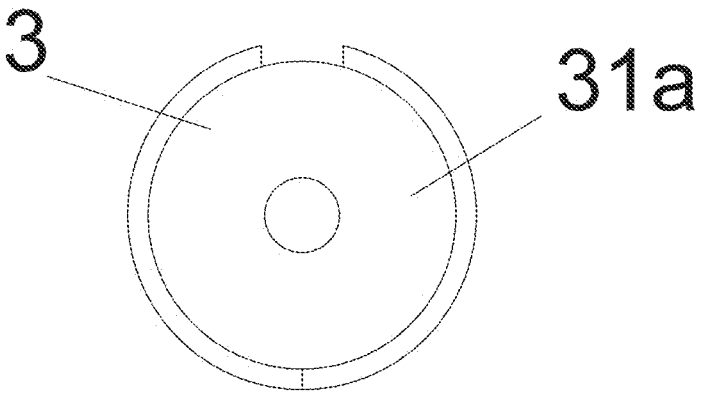
FIG. 15 is a schematic bottom view of the preceding-stage trigger shown in FIG. 14.
Figure 16:
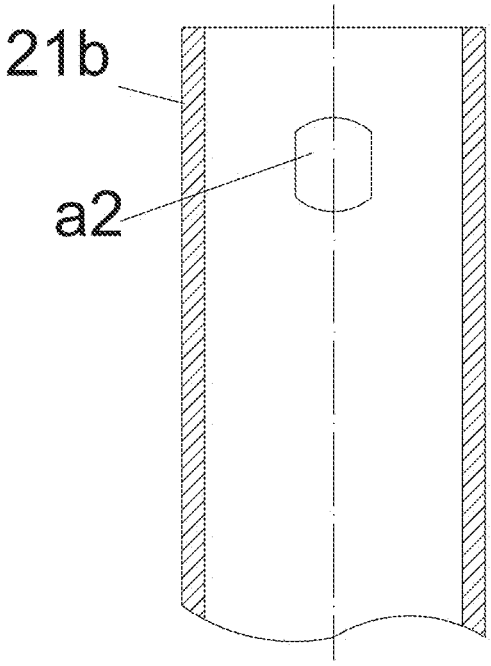
FIG. 16 is a schematic sectional view of a preceding-stage sliding sleeve provided by the disclosure.
Figure 17:
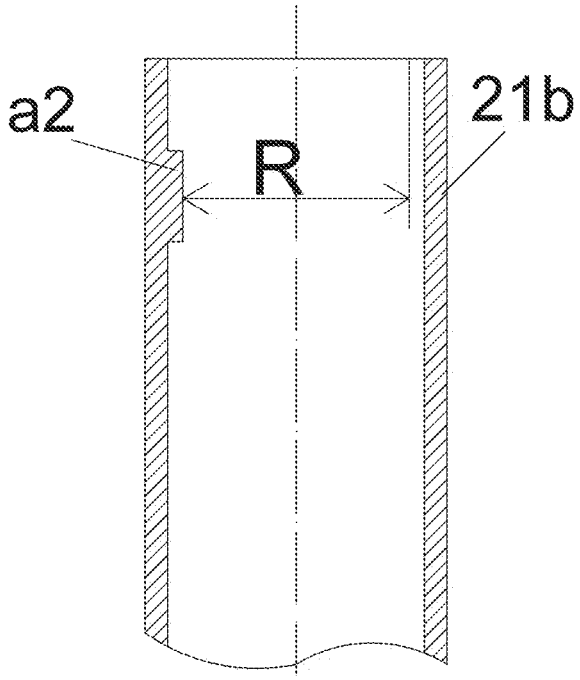
FIG. 17 is another schematic sectional view of the preceding-stage sliding sleeve shown in FIG. 16.
Figure 18:
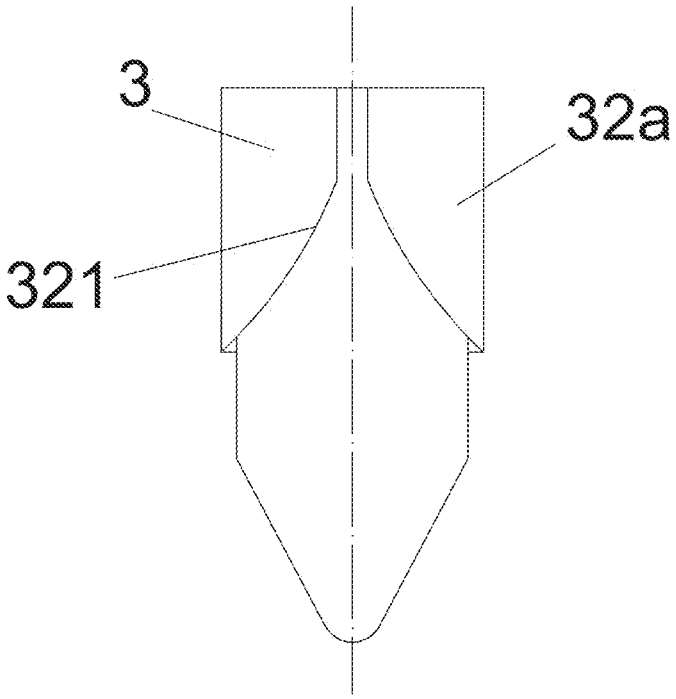
FIG. 18 is a schematic front view of another rear-stage trigger provided by the disclosure.
Figure 19:
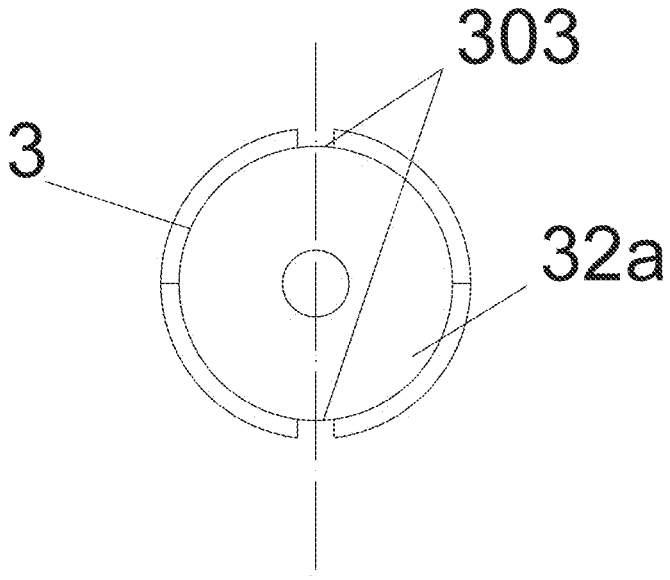
FIG. 19 is a schematic bottom view of the rear-stage trigger shown in FIG. 18.
Figure 20:
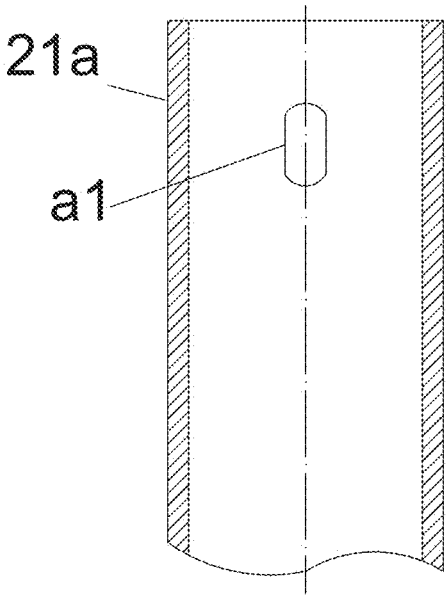
FIG. 20 is a schematic sectional view of another rear-stage sliding sleeve provided by the disclosure.
Figure 21:
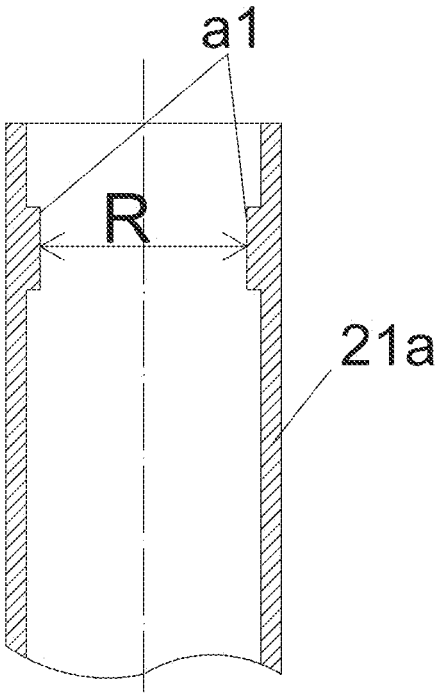
FIG. 21 is another schematic sectional view of the rear-stage sliding sleeve shown in FIG. 20.
Figure 22:
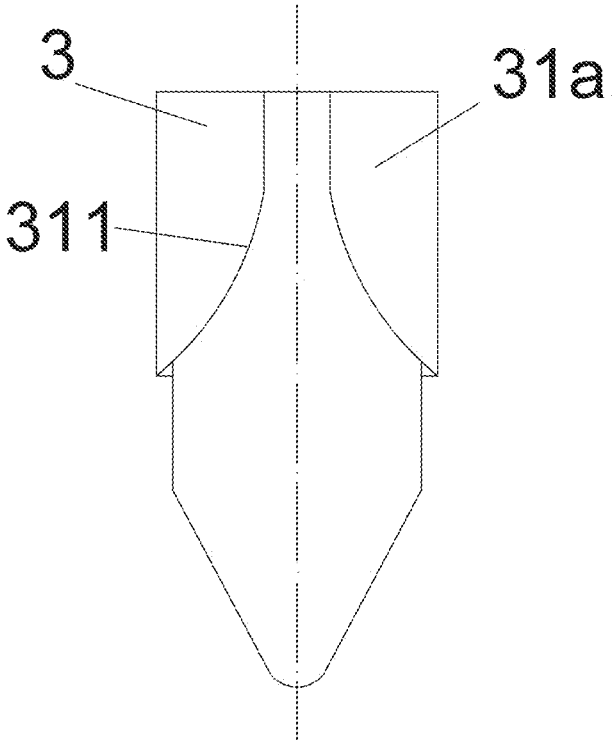
FIG. 22 is a schematic front view of another preceding-stage trigger provided by the disclosure.
Figure 23:
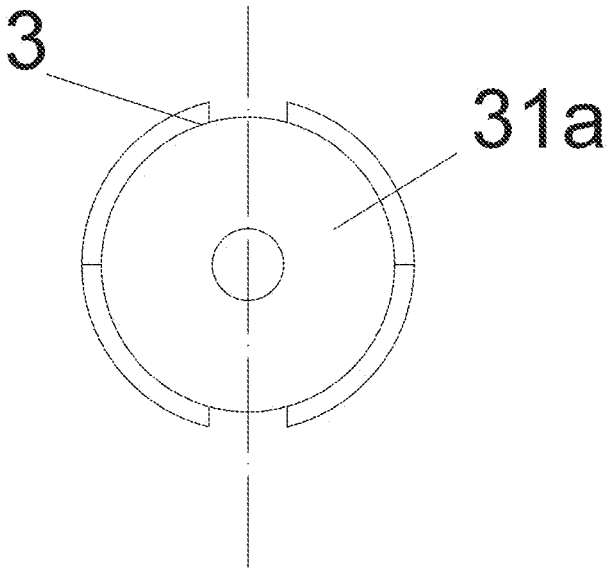
FIG. 23 is a schematic bottom view of the preceding-stage trigger shown in FIG. 22.
Figure 24:
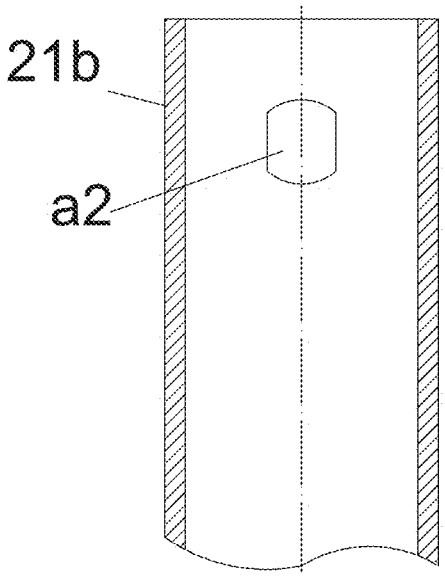
FIG. 24 is a schematic sectional view of another preceding-stage sliding sleeve provided by the disclosure.
Figure 25:
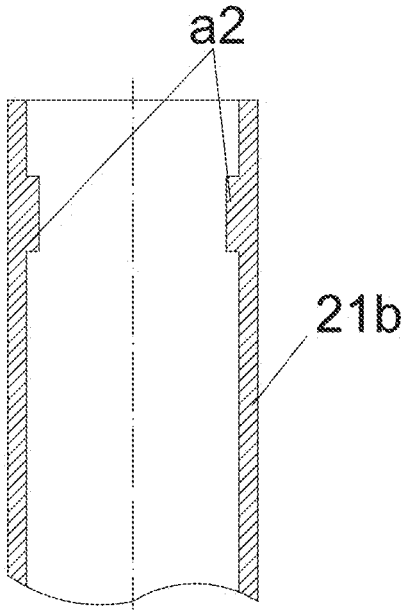
FIG. 25 is another schematic sectional view of the preceding-stage sliding sleeve shown in FIG. 24.
Figure 26:
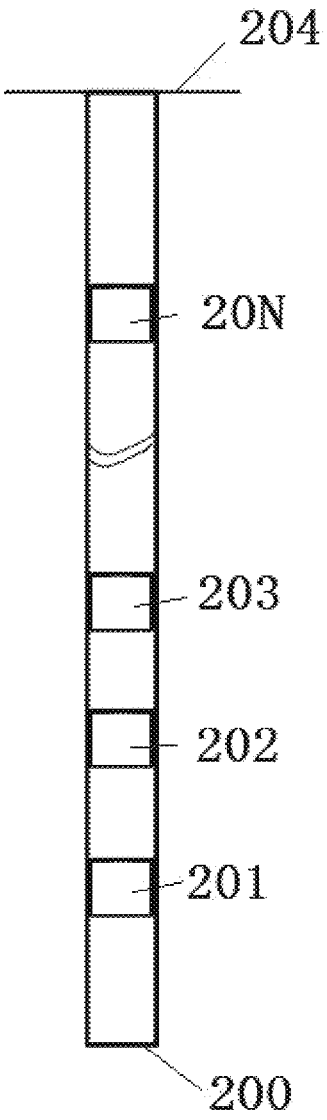
FIG. 26 is a schematic diagram of an outer cylinder provided with multi-stage sliding sleeves according to the disclosure.
Figure 27:
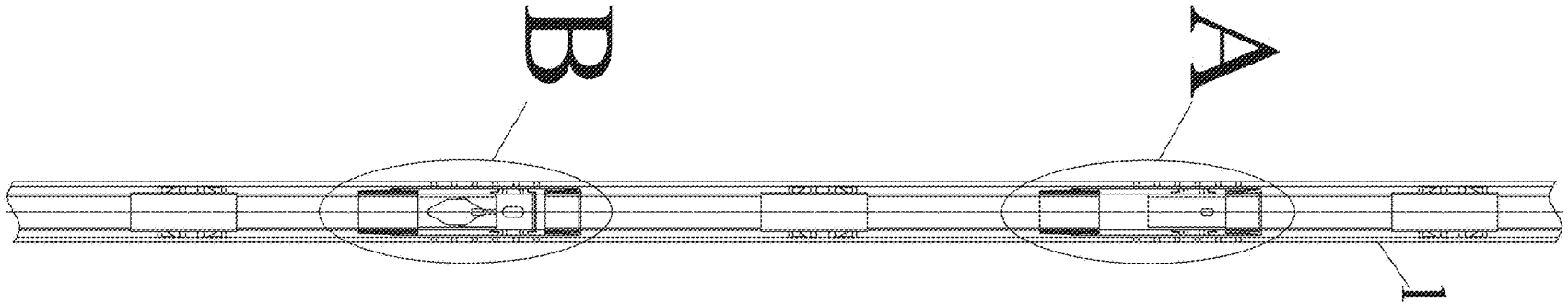
FIG. 27 is a schematic diagram of the process of a preceding-stage trigger driving a preceding-stage sliding sleeve to open the wall through hole after passing through the rear-stage sliding sleeve when the preceding-stage trigger is put into the switch sliding sleeve device for oil-gas exploitation provided by the disclosure.
Figure 28:
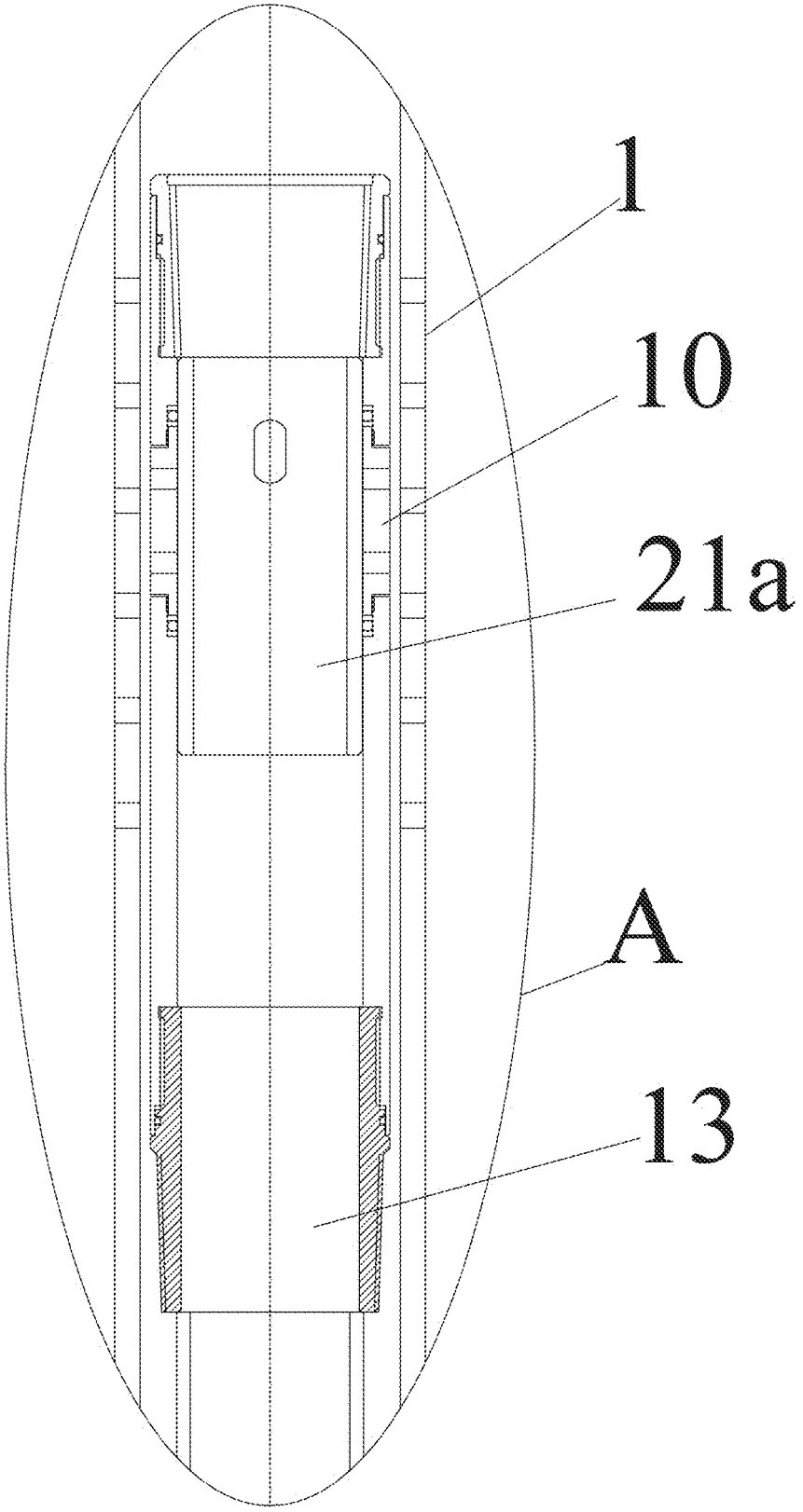
FIG. 28 is an enlarged schematic diagram of area A in FIG. 27.
Figure 29:
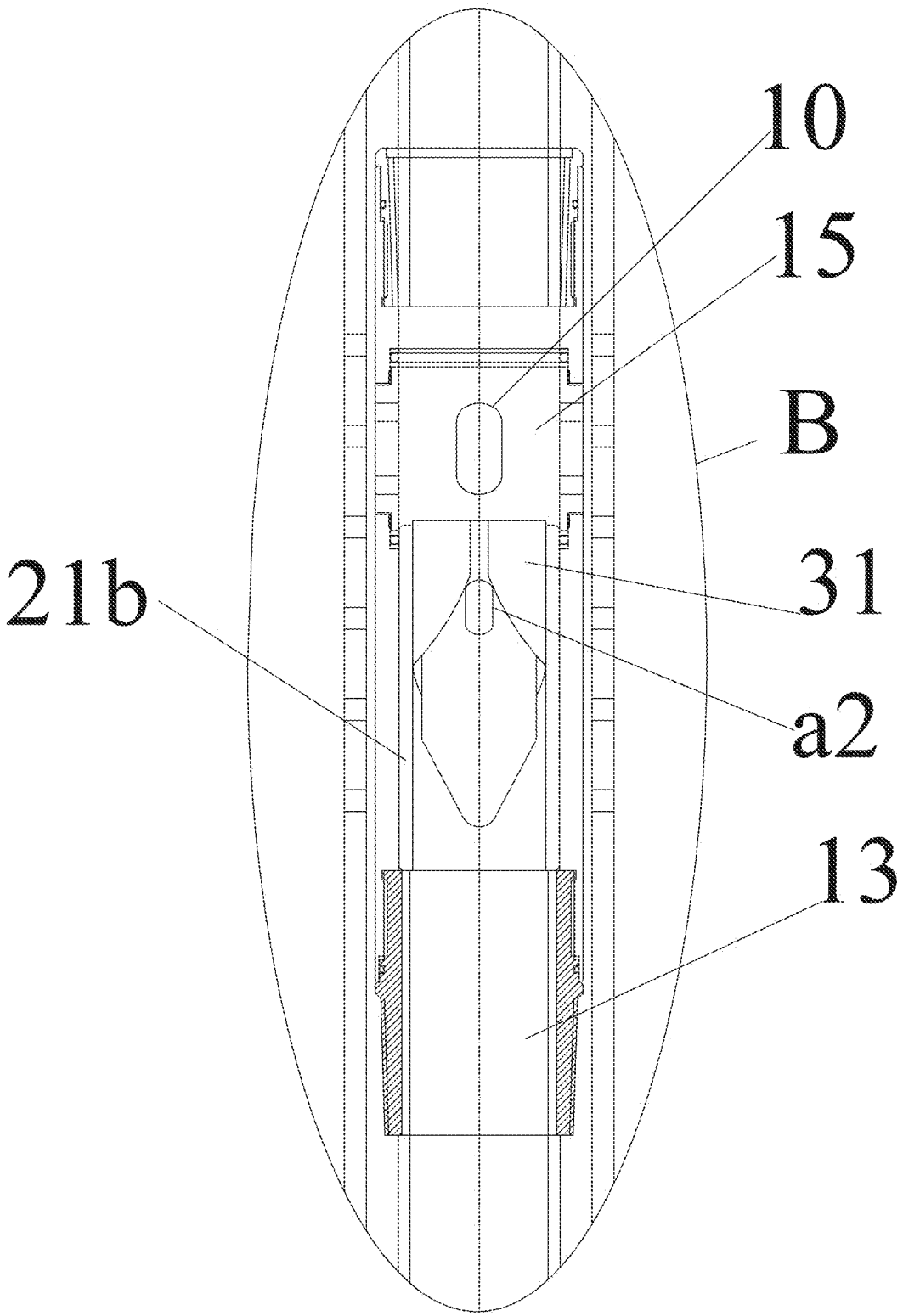
FIG. 29 is an enlarged schematic diagram of area B in FIG. 27.

As a preferred or alternative embodiment, as shown in FIG. 5 and FIG. 6, in the situation that the wall of the outer sliding sleeve is not provided with a radial opening, when one of the first trigger 31 and the second trigger 32 is put into the outer cylinder 1 and punches the upstream end of the inner sliding sleeve 211, the inner sliding sleeve 211 will move downward to close the wall through hole 10, and the inner sliding sleeve 211 moving downward will push the outer sliding sleeve 212 to move upward through the fluid medium.

When the other one of the first trigger 31 and the second trigger 32 is put into the outer cylinder 1 and punches the outer sliding sleeve 212, the punched outer sliding sleeve 212 moves downward and pushes the non-punched inner sliding sleeve 211 to move upward through the fluid medium, so that the inner sliding sleeve 211 no longer blocks (i.e., exposes) the wall through hole 10, and thus the wall through hole 10 is open.

The wall through hole 10 can be closed by putting in the first trigger 31, and can be opened by putting in the second trigger 32. Of course, the first trigger 31 and the second trigger 32 can also be designed to be interchangeable.

As a preferred or alternative embodiment, the upstream end of the outer sliding sleeve 212 has a larger port size than the upstream end of the inner sliding sleeve 211 has. The first trigger 31 and the second trigger 32 are both spheres, and the diameter of the first trigger 31 is different from that of the second trigger 32. Triggers 3 with different sizes are not easy to be taken in error by operators, and thus misoperation can be avoided.

Figure 30:
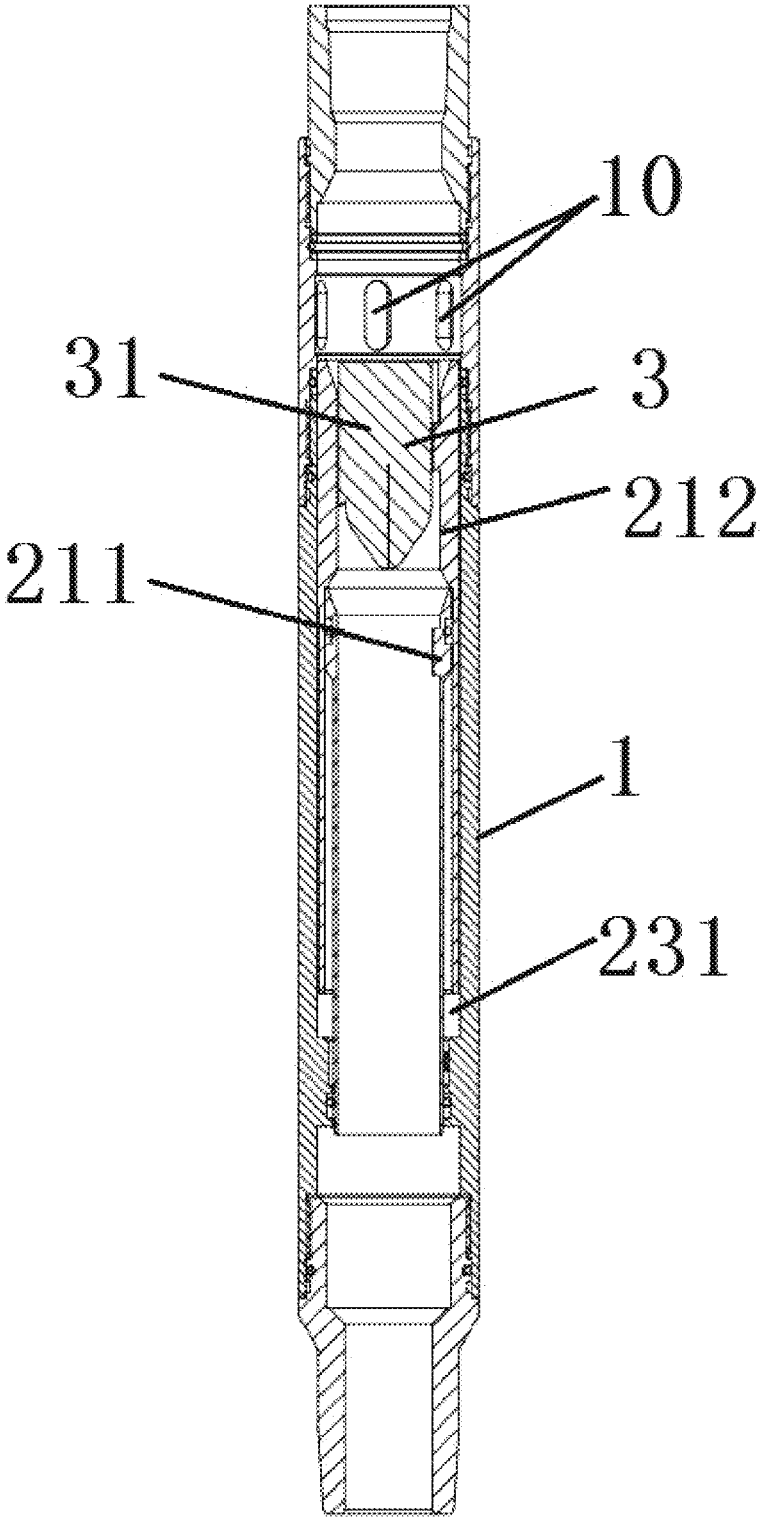
FIG. 30 is a schematic diagram showing that the trigger drives the sliding sleeve to switch from a state of closing to a state of opening in the switching process of another switch sliding sleeve device for oil-gas exploitation device provided by the disclosure.
Figure 31:
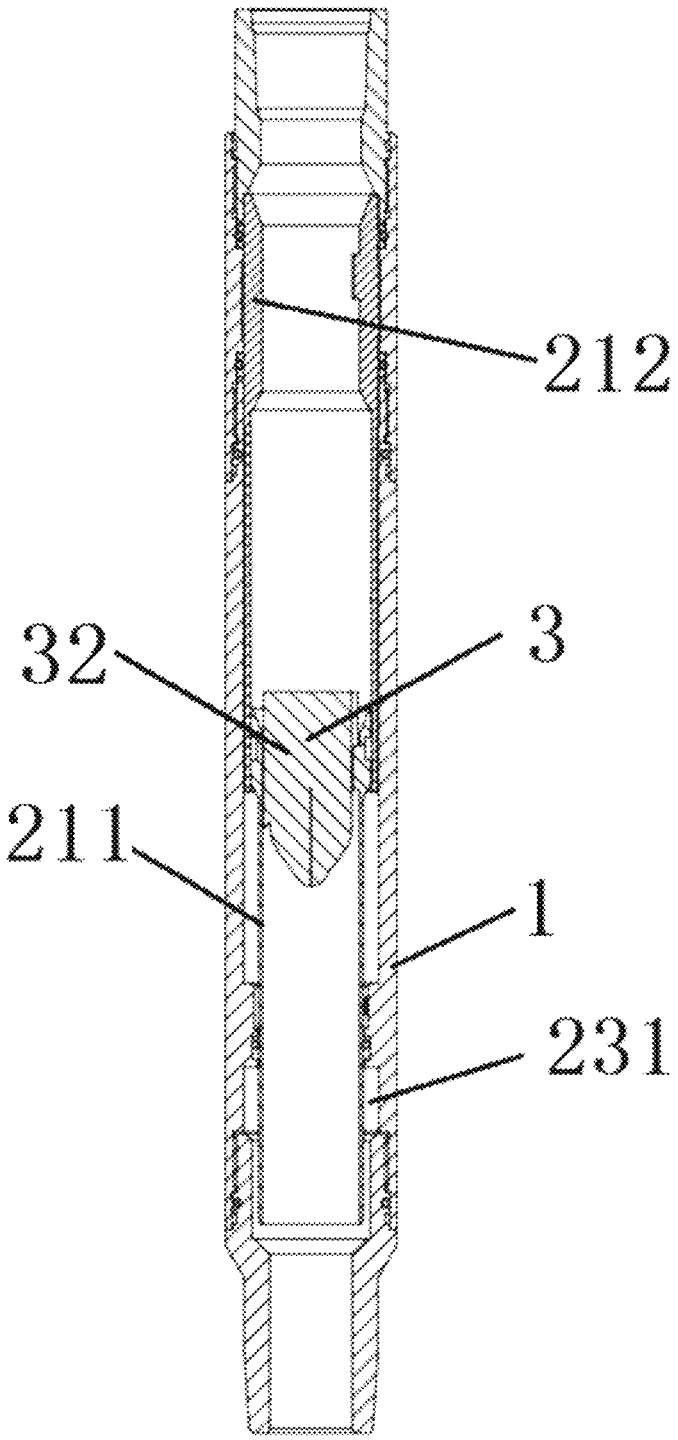
FIG. 31 is a schematic diagram showing that the trigger drives the sliding sleeve to switch from a state of opening to a state of closing in the switching process of the switch sliding sleeve device for oil-gas exploitation shown in FIG. 30.

As a preferred or alternative embodiment, as shown in FIG. 30 and FIG. 31, one of the first trigger 31 and the second trigger 32 only matches with the shape of the outer sliding sleeve and is only capable of driving the matched outer sliding sleeve downward. And the other one of the first trigger and the second trigger only matches with the shape of the inner sliding sleeve and is only capable of driving the matched inner sliding sleeve downward.

Specifically, the outer wall of the first trigger 31 is provided with a first triggering structure (the specific structure may be similar or the same as the rear-stage triggering structure), and the outer sliding sleeve is provided with a first identification structure corresponding to the first triggering structure (the specific structure may be similar or the same as the preceding-stage identification structure). The outer wall of the second trigger 32 is provided with a second triggering structure (the specific structure may be similar or the same as the preceding-stage triggering structure), and the inner sliding sleeve is provided with a second identification structure corresponding to the second triggering structure (the specific structure may be similar or the same as the preceding-stage identification structure).

When the first trigger is put in, and the first trigger moves forward along the direction from well head to well bottom and reaches the first identification structure of the outer sliding sleeve, the first triggering structure is capable of identifying and connecting with the first identification structure, driving the outer sliding sleeve to move forward along the direction from well head to well bottom and opening the wall through hole previously closed by the outer sliding sleeve. Meanwhile, the outer sliding sleeve moving downward pushes the inner sliding sleeve to move upward through the fluid medium.

When a second trigger is put in, and the second trigger moves forward along the direction from well head to well bottom (passes through the first identification structure of the outer sliding sleeve) and reaches the inner sliding sleeve, the second triggering structure is capable of identifying and connecting with the second identification structure, driving the inner sliding sleeve to move forward along the direction from the well head to the well bottom, and pushing the outer sliding sleeve upward through the fluid medium to close the wall through hole.

The inner diameter size of the second identification structure is the same as that of the first identification structure, and the cross-sectional shapes of the second identification structure and the first identification structure are different.

As a preferred or alternative embodiment, the fluid medium 23 is hydraulic oil, water or particles with fluidity, preferably hydraulic oil. The hydraulic oil has better stability and lubricating characteristics, and is suitable as the fluid medium 23.

As a preferred or alternative embodiment, the upstream ends of the inner sliding sleeve 211 and the outer sliding sleeve 212 are respectively provided with conical inner surfaces or are respectively fixedly connected with ball seats provided with conical inner surfaces, and the inner diameter of the conical inner surfaces gradually reduces from upstream to downstream.

The contact area between the conical inner surface and the trigger 3 with spherical structure is large. On one hand, the trigger can better transfer the punching pressure. On the other hand, the upstream ends of the inner sliding sleeve 211 and the outer sliding sleeve 212 are not easy to be broken. Further, before the trigger dissolves or degrades, the upstream and downstream of the respective upstream ends of the inner sliding sleeve 211 and the outer sliding sleeve 212 can be blocked, which is convenient for oil-gas exploitation.

The disclosure provides a method for reversing a switch by putting in trigger 3 (preferably a ball) to punching control a hydraulic cavity. The lower ends of the inner sleeve and the outer sleeve are respectively inserted into the same closed hydraulic cavity. The upper ends of the inner sleeve and the outer sleeve are respectively provided with ball seats. The inner sleeve and the outer sleeve are sealed with each other through a sealing ring 4.

When the ball is seated in the inner sleeve ball seat, the pressure forces the inner sleeve to move downward, the lower end of the inner sleeve forces the hydraulic chamber to generate pressure, and the inner pressure in the hydraulic chamber pushes the outer sleeve to move upward.

When the ball is seated in the outer sleeve ball seat, the pressure forces the outer sleeve to move downward, the lower end of the outer sleeve forces the hydraulic chamber to generate pressure, and the inner pressure in the hydraulic chamber pushes the inner sleeve to move upward.

By setting attributes at different positions, the reciprocating motion of the sleeves can be reliably controlled by the trigger 3, and the reciprocating motion between different attributes can be realized.

As a preferred or alternative embodiment, the outer sliding sleeve 212 is provided with a stop flange, and when the outer sliding sleeve 212 moves downward to the position of closing the wall through hole 10, the stop flange abuts against the upstream end of the inner sliding sleeve 211. The stop flange can reduce the downward moving distance of the outer sliding sleeve 212, reduce the sliding stroke of the outer sliding sleeve 212 during the switching process, and improve the response speed of the switch.

As a preferred or alternative embodiment, in the situation that the wall of the inner sliding sleeve 211 is provided with an inner wall opening 110, when the radial opening 120 of the outer sliding sleeve 212, the inner wall opening 110 of the inner sliding sleeve 211 and the wall through hole 10 coincide, the wall through hole 10 is in an open state; and, when the radial opening 120 of the outer sliding sleeve 212, the inner wall opening 110 of the inner sliding sleeve 211 and the wall through hole 10 are staggered, the wall through hole 10 is in a closed state.

Or, in the situation that the wall of the inner sliding sleeve 211 is not provided with an inner wall opening 110, when the radial opening of the outer sliding sleeve coincides with the wall through hole and are not blocked by the inner sliding sleeve, the wall through hole is in an open state; and, when the radial opening of the outer sliding sleeve is staggered or one of them is blocked by the inner sliding sleeve, the wall through hole is in a closed state. In the above-mentioned structure, when wall through hole 10 is closed, a two-layer sealing structure is formed, and the sealing effect is better.

The oil-gas exploitation tool provided by the embodiment of the disclosure includes the switch sliding sleeve device for oil-gas exploitation provided by any technical solution of the disclosure.

Figure 2:
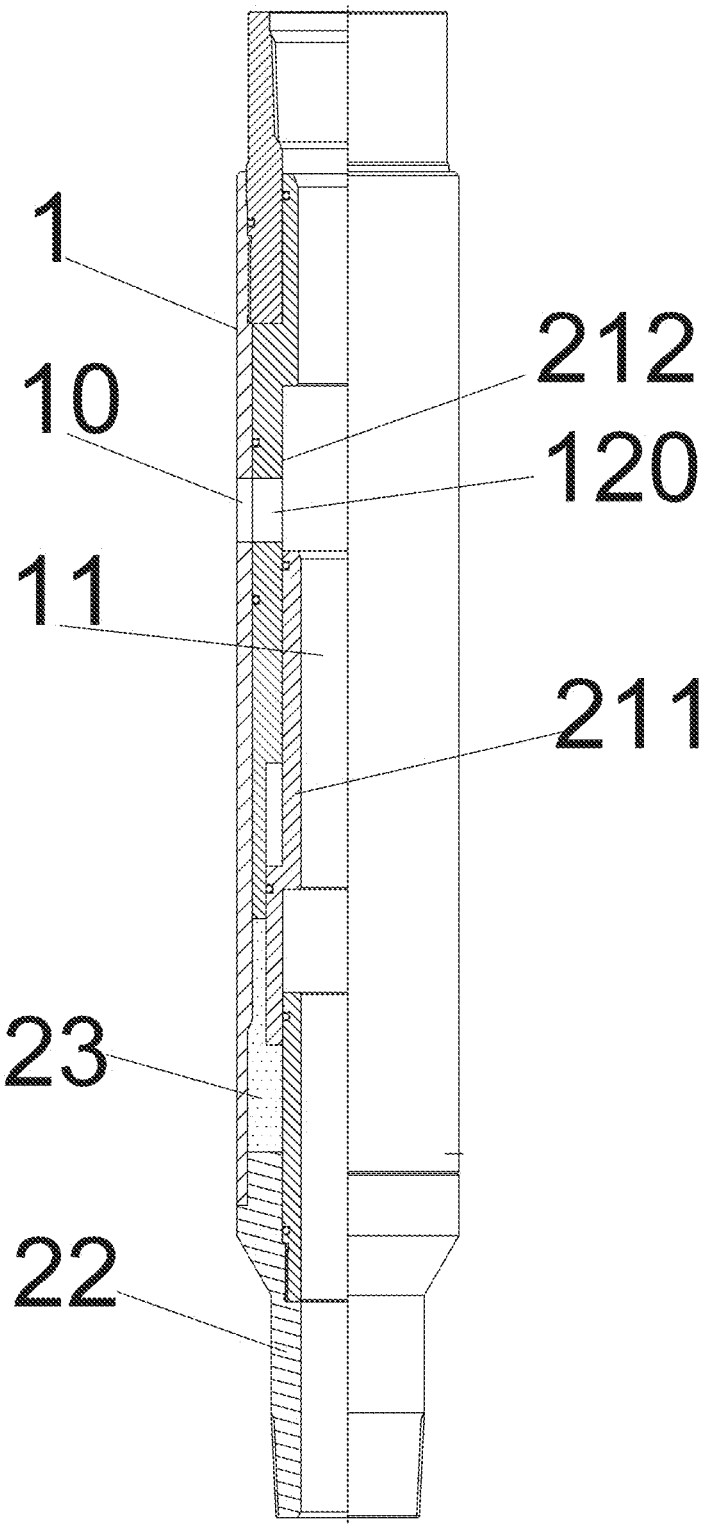
FIG. 2 is a schematic diagram of a sliding sleeve tool applied by a switch sliding sleeve device for oil-gas exploitation provided by an embodiment of the disclosure.
Figure 3:
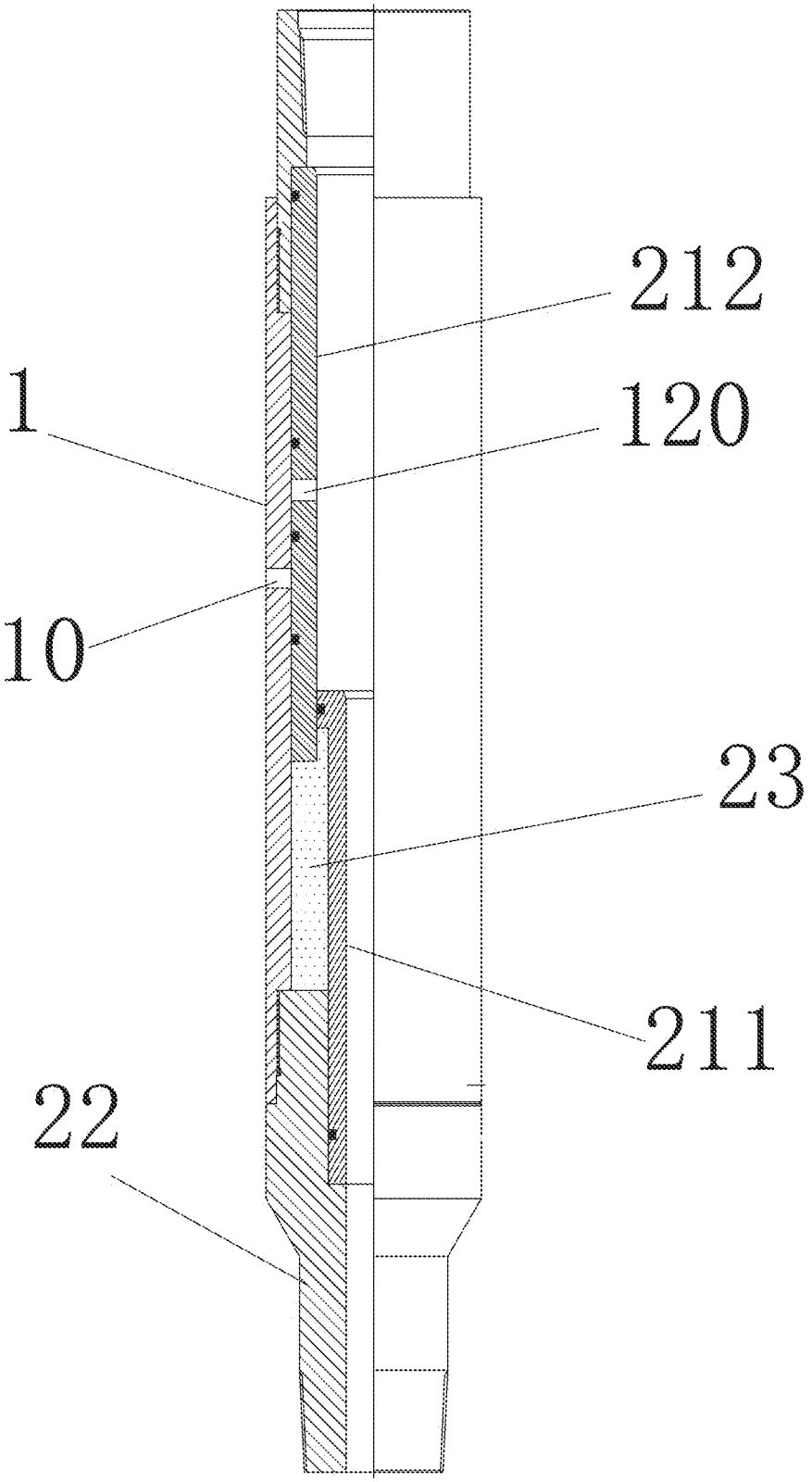
FIG. 3 is a schematic diagram of a sliding sleeve tool applied by a switch sliding sleeve device for oil-gas exploitation according to another embodiment of the embodiment of the disclosure.
Figure 4:
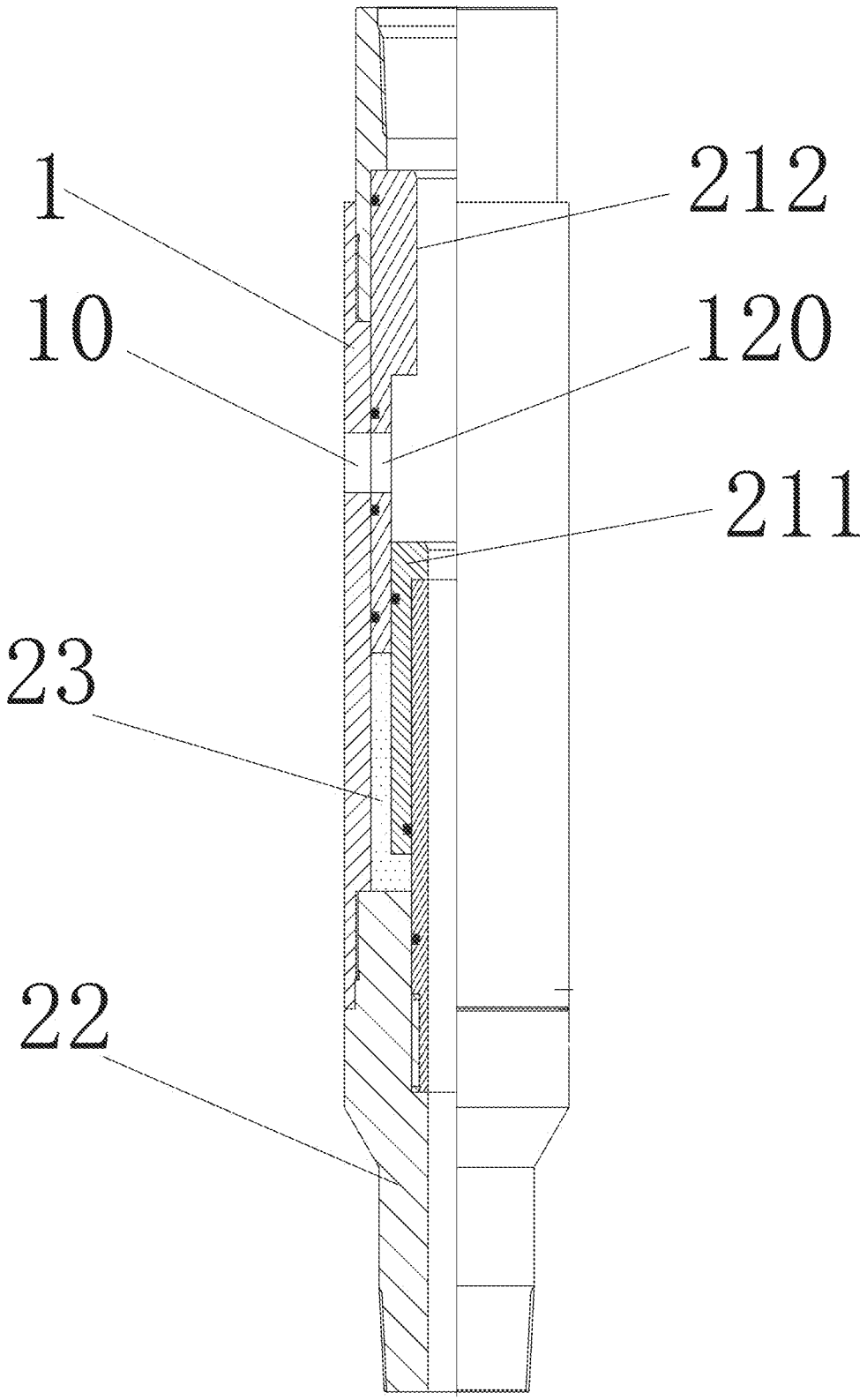
FIG. 4 is a schematic diagram of a sliding sleeve tool applied by a switch sliding sleeve device for oil-gas exploitation according to yet another embodiment of the embodiment of the disclosure.

As a preferred or alternative embodiment, the oil-gas exploitation tool is a sliding sleeve tool as shown in FIGS. 2-4 or a packer as shown in FIGS. 5 and 6.

The packer includes rubber cylinder 5 and fluid channel 6. The fluid channel 6 is preferably formed by the gap among outer tube 71, inner tube 72, rubber cylinder 5 and outer tube 1.

When wall through hole 10 is in an open state, the fluid in the inner fluid channel 11 of the outer tube 1 can flow out through wall through hole 10 and fluid channel 6 in turn and push rubber cylinder 5 to deform and set in a casing or oil-gas well where the packer is located.

When wall through hole 10 is in a closed state, the fluid in the fluid channel 6 can keep the rubber cylinder 5 deformed and set in the casing or oil-gas well where the packer is located.

When the wall through hole 10 is in an opened state again, the fluid in the fluid channel 6 flows into the internal fluid channel 11 of the outer cylinder 1 through the fluid channel 6 and the wall through hole 10 to restore the shape of the rubber cylinder 5 before setting and release setting.

The disclosure can be applied to sliding sleeve tools. In this case, the outer cylinder 1 is perforated as so to be open when the outer sleeve moves downward and be closed when the outer sleeve moves upward. Thus, the switching of the sliding sleeve 21 can be controlled by different balls.

The disclosure can also be applied to packers (for example, K441 packer), so that the outer sleeve moves downward to block the liquid inlet hole, and the outer sleeve moves upward to open the liquid inlet hole. The setting and unsetting of packer can be controlled by putting in balls.

The switching method of the wall through hole 10 of the oil-gas exploitation tool provided by the embodiment of the disclosure may include the following steps:

Step A, the trigger 3 is put into the outer cylinder 1 of the switch sliding sleeve device for oil-gas exploitation provided by any technical solution of the embodiment of the disclosure. When the trigger 3 punching triggers the switch sliding sleeve mechanism 2, the switch sliding sleeve mechanism 2 can be switched from the state of opening the wall through hole 10 to the state of closing the wall through hole 10.

Step B, the trigger 3 is put into the outer cylinder 1 again. The sliding sleeve mechanism 2 switches from the state of closing the wall through hole 10 back to the state of opening the wall through hole 10 when triggered by the trigger 3 or another trigger 3 again.

The switching method of the wall through hole 10 of the oil-gas exploitation tool provided by the embodiment of the disclosure may include the following steps:

Step A, the trigger 3 is put into the outer cylinder 1 of the switch sliding sleeve device for oil-gas exploitation provided by any technical solution of the embodiment of the disclosure. When the trigger 3 punching triggers the switch sliding sleeve mechanism 2, the switch sliding sleeve mechanism 2 can be switched from the state of closing the wall through hole 10 to the state of opening the wall through hole 10.

Step B, the trigger 3 is put into the outer cylinder 1 again. The sliding sleeve mechanism 2 switches from the state of opening the wall through hole 10 to the state of closing the wall through hole 10 when triggered by the trigger 3 or another trigger 3 again.

In the initial state of switching the sliding sleeve mechanism 2, whether the wall through hole 10 is open or closed can be set manually.

The disclosure provides a switch sliding sleeve device for oil-gas exploitation, an oil-gas exploitation tool provided with the switch sliding sleeve device, and a switching method of the switch sliding sleeve device, which has large internal circulation area and no series limit and path limit.

As shown in FIG. 9-29, the switch sliding sleeve device for oil-gas exploitation provided by the disclosure includes an outer cylinder 1, a trigger 3 and a sliding sleeve 21.

The inner cavity of the outer cylinder 1 forms an internal fluid channel 11, and the sidewall of the outer cylinder 1 is provided with a plurality of wall through hole 10 which are communicated with the internal fluid channel 11 and have different positions along the direction from the well head to the well bottom 200.

The sliding sleeve 21 includes a rear-stage sliding sleeve 21*a* and a preceding-stage sliding sleeve 21*b*. The rear-stage sliding sleeve 21*a* locates closer to the well head and the preceding-stage sliding sleeve 21*b* locates closer to the well bottom. The rear-stage sliding sleeve 21*a* is preferably higher than the preceding-stage sliding sleeve 21*b*. At this time, the rear-stage sliding sleeve 21*a* can move forward along the direction from the well head to the well bottom (of the well in which the switch sliding sleeve device for oil-gas exploitation is located) by gravity. When the position of the rear-stage sliding sleeve 21*a* is the same as or lower than that of the preceding-stage sliding sleeve 21*b* in the vertical direction, the rear-stage sliding sleeve 21*a* can also move downward or along the direction from the well head to the well bottom under the thrust exerted by external fluid or mechanism.

The preceding-stage sliding sleeve 21*b* and the rear-stage sliding sleeve 21*a* are respectively slidably or detachably connected to the outer cylinder 1

The trigger 3 includes a preceding-stage trigger 31*a* and a rear-stage trigger 32*a*. The outer wall of the preceding-stage trigger 31*a* is provided with a preceding-stage triggering structure 311, and the inner wall of the preceding-stage sliding sleeve 21*b* is provided with a preceding-stage identification structure a2 corresponding to the preceding-stage triggering structure 311.

The outer wall of the rear-stage trigger 32*a* is provided with a rear-stage triggering structure 321, and the inner wall of the rear-stage sliding sleeve 21*a* is provided with a rear-stage identification structure a1 corresponding to the rear-stage triggering structure 321.

When the preceding-stage trigger 31*a* is put into the outer cylinder 1, and the preceding-stage trigger 31*a* moves forward along the direction from well head to well bottom, passes through the rear-stage identification structure a1 of the rear-stage sliding sleeve 21*a*, and reaches the preceding-stage sliding sleeve 21*b*, the preceding-stage triggering structure 311 is capable of identifying and connecting with the preceding-stage identification structure a2, driving the preceding-stage sliding sleeve 21*b* to move forward along the direction from well head to well bottom and open the wall through hole 10 previously closed by the preceding-stage sliding sleeve 21*b* (preferably with relatively low height).

When the rear-stage trigger 32*a* is put into the outer cylinder 1, and the rear-stage trigger 32*a* moves forward along the direction from well head to well bottom and reaches to the rear-stage sliding sleeve 21*a*, the rear-stage triggering structure 321 is capable of identifying and connecting with the rear-stage identification structure a1, driving the rear-stage sliding sleeve 21*a* to move forward along the direction from well head to well bottom and open the wall through hole 10 previously closed by the rear-stage sliding sleeve 21*a* (preferably with relatively high position and height).

The inner diameter R of the rear-stage recognition structure a1 is the same as the inner diameter R of the preceding-stage recognition structure a2, and the shapes of cross sections (cross sections perpendicular to the direction from well head to well bottom) of the rear-stage recognition structure a1 and the preceding-stage recognition structure a2 are different.

The contour lines of the inner edges of the rear-stage recognition structure a1 and the preceding-stage recognition structure a2 are preferably round, and can also be oval, oblong or rectangular. Accordingly, the contour lines of the outer edges of the preceding-stage triggering structure 311 and the rear-stage triggering structure 321 can also be elliptical, oblong or rectangular.

In the switch sliding sleeve 21 device for oil-gas exploitation provided by the disclosure, the inner diameter R of the rear-stage identification structure a1 is the same as that of the preceding-stage identification structure a2, and the cross-sectional shapes of the rear-stage identification structure a1 and the preceding-stage identification structure a2 are different. Thus, the inner diameters R of the identification structures of different stages are consistent. And therefore, in order to choose which stage of sliding sleeve is to be used to open, it is only need to change the cross-sectional shape of the identification structure and the shape of the triggering structure matched with it.

Since the increase of sliding sleeve stages will not change the inner diameter size of sliding sleeve or even circulation area, the sliding sleeve is located in the outer cylinder, the inner diameter of the outer cylinder depends on the inner diameter of the sliding sleeve, and the inner diameter of the sliding sleeve depends on the inner diameter of the identification structure, so the circulation area inside the outer cylinder will not reduce stage by stage or reduce too much with the reduce of circulation area of the inner wall of the sliding sleeves.

As a preferred or alternative embodiment, the part of the rear-stage sliding sleeve 21*a* excluding the rear-stage identification structure a1 and the part of the preceding-stage sliding sleeve 21*b* excluding the preceding-stage identification structure a2 have inner walls with coincident projections in the direction from well head to well bottom.

Since the circulation area in the outer cylinder 1 will not reduce stage by stage with the reduce of the circulation area of the inner wall of the sliding sleeve 21, the influence of the rear-stage identification structure a1 and the preceding-stage identification structure a2 on the circulation area is very small, even negligible.

As an optional embodiment, both the preceding-stage triggering structure 311 and the rear-stage triggering structure 321 are formed by sidewalls of grooves with different width sizes, and the rear-stage recognition structure a1 and the preceding-stage recognition structure a2 are protrusions with different sizes.

Or, the preceding-stage triggering structure 311 and the rear-stage triggering structure 321 are protrusions with different sizes, and the rear-stage recognition structure a1 and the preceding-stage recognition structure a2 are formed by sidewalls of grooves with different width sizes.

Or, the preceding-stage triggering structure 311 and the rear-stage triggering structure 321 are formed by the sidewalls of different numbers of grooves, and the rear-stage recognition structure a1 and the preceding-stage recognition structure a2 are different numbers of protrusions.

Or, the preceding-stage triggering structure 311 and the rear-stage triggering structure 321 are different numbers of protrusions, and the rear-stage recognition structure a1 and the preceding-stage recognition structure a2 are formed by sidewalls of different numbers of grooves.

The above-mentioned design has the advantages that the preceding-stage trigger 31*a* and the rear-stage trigger 32*a* are similar in shape and have high consistency with each other, meanwhile, the structure of the groove and the protrusion is relatively simple, thus the structures are convenient to process and manufacture and the manufacturing cost is low.

As an alternative embodiment, the length direction of the protrusion extends along the axial direction of the device, and the shape of the axial section of the protrusion is oblong, oval or round. Such a structure is less prone to stress concentration when bearing punching force from the preceding-stage trigger 31*a* and the rear-stage trigger 32*a*, and has strong structural reliability and longer service life.

As an optional embodiment, both the preceding-stage triggering structure 311 and the rear-stage triggering structure 321 are formed by the sidewalls of the groove 303, and the preceding-stage trigger 31*a* and the rear-stage trigger 32*a* each includes a blocking body 301, an outer boss 302 and the groove 303.

The blocking body 301 includes a conical lower part and a cylindrical upper part. The outer boss 302 is fixedly arranged on the outer wall of the upper part of the blocking body 301, and the outer diameter of the outer boss 302 is larger than the maximum outer diameter of the blocking body 301. The groove 303 runs through the outer boss 302 along the axial direction.

The trigger 3 with the above structure is close to the warhead in shape, with small falling resistance, large punching force and strong trigger reliability.

As an optional embodiment, the width direction of the groove 303 is parallel to the circumferential direction of the outer cylinder 1, and the width size of the groove 303 gradually reduces along the direction from the well bottom to the well head.

The width size of the narrowest section (preferably the top section) of the groove 303 is 1/20 to 1/5 (preferably 1/10 to 1/8) of the outer diameter size of the outer boss.

And/or, the width size of the widest section of the protrusion is 1/20 to 1/5 (preferably 1/9-1/7) of the inner diameter R of the inner wall of the outer cylinder.

And/or, the radial (which is the same as the radial direction of the sliding sleeve) size of the protrusion is 1/40 to 1/5(preferably 1/15-1/10) of the inner diameter R of the inner wall of the outer cylinder.

The specific size of the groove 303 can be appropriately increased or decreased according to the rigidity of the material, and the size of the protrusion matched with the groove 303 changes accordingly with the size of the groove 303.

On the one hand, the above-mentioned structure facilitates the preceding-stage triggering structure 311 to slide past the rear-stage identification structure a1 on the rear-stage sliding sleeve 21*a*. Meanwhile, when the preceding-stage triggering structure 311 punches with the preceding-stage identification structure a2, stress concentration is unlikely to occur, and the product has strong reliability and long service life.

As an alternative embodiment, the sidewall of the groove 303 is formed by smooth transition between a curved surface 304 (preferably an arc surface) and a flat surface 305.

The resistance of the above-mentioned structure sliding past the rear-stage identification structure a1 of the rear-stage sliding sleeve 21*a* is smaller, and the probability of stress concentration is smaller when it punches the preceding-stage identification structure a2, so the reliability of the product is stronger and the service life is longer.

As an alternative embodiment, the grooves 303 on the outer wall of the preceding-stage trigger 31*a* and the grooves 303 on the outer wall of the rear-stage trigger 32*a* are of the same number but of different width sizes, or are of different numbers but of the same width sizes. The disclosure can be realized as long as the preceding-stage trigger 31*a* can pass through the rear-stage sliding sleeve 21*a* without obstacle to trigger the preceding-stage sliding sleeve 21*b* to open, the rear-stage trigger 32*a* can only be intercepted by the rear-stage sliding sleeve 21*a* and trigger the rear-stage sliding sleeve 21*a* to open.

As an optional embodiment, the number of grooves 303 on the outer wall of the preceding-stage trigger 31*a*, the number of grooves 303 on the outer wall of the rear-stage trigger 32*a*, the number of protrusions on the inner wall of the rear-stage sliding sleeve 21*a* and the number of protrusions on the inner wall of the preceding-stage sliding sleeve 21*b* may be the same, or may be different. FIG. 1 shows the situation in which the numbers are the same. The smaller the number of protrusions, the larger the circulation area inside the sliding sleeve 21 and the outer cylinder 1. So, the smaller the number of protrusions and grooves 303, the better.

As an optional embodiment, the number of grooves 303 on the outer wall of the preceding-stage trigger 31*a*, the number of grooves 303 on the outer wall of the rear-stage trigger 32*a*, the number of protrusions on the inner wall of the rear-stage sliding sleeve 21*a* and the number of protrusions on the inner wall of the preceding-stage sliding sleeve 21*b* are all the same, and the number is at least two. The grooves 303 are evenly distributed on the outer wall of the rear-stage trigger 32*a* or the preceding-stage trigger 31*a* along the circumferential direction, and the protrusions are evenly distributed on the inner wall of the rear-stage sliding sleeve 21*a* or the preceding-stage sliding sleeve 21*b* along the circumferential direction.

The trigger 3 with the above structure has better symmetry, is more stable while falling. Meanwhile, the protrusion has stronger ability of bearing punching force, and the success rate of triggering the sliding sleeve 21 to open is higher.

As an alternative embodiment, the rear-stage identification structure a1 is arranged at the upper or middle part of the rear-stage sliding sleeve 21*a*, and the preceding-stage identification structure a2 is arranged at the upper or middle part of the preceding-stage sliding sleeve 21*b*.

Such a design of above-mentioned structure makes at least partial structure of the trigger 3 locate in the sliding sleeve 21 when the trigger 3 drives the sliding sleeve 21. The trigger 3 will not block the wall through hole 10, and the axial size of the sliding sleeve 21 can be made smaller, and thus saving more materials.

As an alternative embodiment, the part of the inner wall of the rear-stage sliding sleeve 21*a* excluding the rear-stage identification structure a1 and the part of the inner wall of the preceding-stage sliding sleeve 21*b* excluding the preceding-stage identification structure a2 have coincident projections in the direction from the well head to the well bottom. The recognition structure a1 only plays the role of recognition, so its occupied space can be designed to be smaller, which is convenient for processing and manufacturing.

When the preceding-stage trigger 31*a* and the rear-stage trigger 32*a* are put into the outer cylinder 1, both the preceding-stage trigger 31*a* and the rear-stage trigger 32*a* move forward along the direction from the well head to the well bottom under the action of their own weight.

By using merely self-weight to drive the trigger 3, not only the cost can be reduced, but also the failure caused by setting other driving mechanisms can be avoided.

As an optional embodiment, among the outer cylinder 1, the preceding-stage trigger 31*a*, the rear-stage trigger 32*a* and the sliding sleeve 21, at least the preceding-stage trigger 31*a* and the rear-stage trigger 32*a* are made of soluble (in water) or degradable (in water) materials. Soluble or degradable materials can prevent the trigger 3 from blocking the outer cylinder 1 for an over long time.

As an optional embodiment, the inner diameters R of the respective axial (in the disclosure, the axial direction may or may not coincide with the height direction) sections of the inner wall of the outer cylinder 1 are the same.

The inner diameters R of the respective axial sections of the part of the inner wall of the rear-stage sliding sleeve 21*a* excluding the rear-stage identification structure a1 and the part of the inner wall of the preceding-stage sliding sleeve 21*b* excluding the preceding-stage identification structure a2 are the same.

The (maximum) outer diameter of the respective axial sections of the part of the outer wall of the preceding-stage trigger 31*a* excluding the preceding-stage triggering structure 311 and the part of the outer wall of the rear-stage trigger 32*a* excluding the rear-stage triggering structure 321 are the same.

In the outer cylinder 1 with the above structure, the part of the inner wall of the rear-stage sliding sleeve 21*a* excluding the rear-stage identification structure a1, the part of the inner wall of the preceding-stage sliding sleeve 21*b* excluding the preceding-stage identification structure a2 and the trigger 3 are all rotary structures, which are not only convenient to manufacture, but also stable in falling and good in directionality.

As an optional embodiment, when the preceding-stage sliding sleeve 21*b* moves forward along the direction from well head to well bottom and opens the wall through hole 10 previously closed by the preceding-stage sliding sleeve 21*b*, the preceding-stage trigger 31*a* provided with the preceding-stage triggering structure 311 sets and closes the inner channel (which can be the upper port) of the preceding-stage sliding sleeve 21*b*. When the rear-stage sliding sleeve 21*a* moves forward along the direction from well head to well bottom and opens the wall through hole 10 previously closed by the rear-stage sliding sleeve 21*a*, the rear-stage trigger 32*a* provided with the rear-stage triggering structure 321 sets and closes the inner passage (which can be the upper port) of the rear-stage sliding sleeve 21*a*.

After the sliding sleeve 21 is blocked by the trigger 3, a layered circulation structure along the axial direction can be formed in the outer cylinder 1, which is beneficial to realize layered fracturing and layered oil-gas exploitation.

As an optional embodiment, the outer cylinder 1 includes a cylinder body 12, an upper joint 14, a lower joint 13, a nozzle wall plate 15 and a sealing ring 4.

The upper joint 14 is detachably connected with the upper end of the cylinder body 12, and the lower joint 13 is detachably connected with the lower end of the cylinder body 12. When the sliding sleeve 21 opens the wall through hole 10, the bottom end of the sliding sleeve 21 abuts against the lower joint 13. The preceding-stage trigger 31*a* is embedded in the preceding-stage sliding sleeve 21*b* or the rear-stage trigger 32*a* is embedded in the rear-stage sliding sleeve 21*a*.

The nozzle wall plate 15 is arranged on the opening of the wall of the cylinder body 12, and the wall through hole 10 is formed by the through hole provided on the nozzle wall plate. The sealing ring 4 is interposed among the nozzle wall plate 15, the wall of the cylinder body 12 and the sliding sleeve 21 which is at the position of closing the wall through hole 10 (the position before moving forward along the direction from well head to well bottom), and the sliding sleeve 21 temporarily stays at the position of closing the wall through hole 10 under the friction of the sealing ring 4 until the trigger drives the sliding sleeve to move forward and open the wall through hole previously closed by the sliding sleeve.

The above structure has the advantages of convenient processing and manufacturing and easy triggering of the sliding sleeve 21.

The oil-gas exploitation tool provided by the embodiment of the disclosure includes the switch sliding sleeve 21 device for oil-gas exploitation provided by any technical solution of the embodiment of the disclosure, and the oil-gas exploitation tool is a sliding sleeve 21 tool or a packer.

The sliding sleeve 21 tool or packer (for example, the sliding sleeve 21 tool or packer in the Chinese patent document with the application number of 201911102352.7) can apply the switch sliding sleeve device 21 for oil-gas exploitation provided by the disclosure.

The switching method of the switch sliding sleeve device 21 for oil-gas exploitation provided by any technical solution of the embodiment of the disclosure includes the following steps A and B.

In step A, the preceding-stage trigger 31*a* is put into the outer cylinder 1, and when the preceding-stage trigger 31*a* moves forward along the direction from well head to well bottom, passes through the rear-stage identification structure a1 of the rear-stage sliding sleeve 21*a*, and reaches the preceding-stage sliding sleeve 21*b*, the preceding-stage triggering structure 311 identifies and connects with the preceding-stage identification structure a2 and drives the preceding-stage sliding sleeve 21*b* to move forward along the direction from well head to well bottom and open the wall through hole 10 (preferably with relatively low height) previously closed by the preceding-stage sliding sleeve 21*b*.

In step B, the rear-stage trigger 32*a* is put into the outer cylinder 1, and when rear-stage trigger 32*a* moves forward along the direction from well head to well bottom and reaches the rear-stage sliding sleeve 21*a*, the rear-stage triggering structure 321 identifies and connects the rear-stage identification structure a1 and drives the rear-stage sliding sleeve 21*a* to move forward along the direction from well head to well bottom and open the wall through hole 10 (preferably with relatively high height) previously closed by the rear-stage sliding sleeve 21*a*.

The above steps can reliably trigger the sliding sleeve 21 through the trigger 3 and open the wall through hole 10 previously closed by the sliding sleeve 21.

The switching method of a switch sliding sleeve device for oil-gas exploitation provided by the embodiment of the disclosure may also include the following steps A and B.

In step A, the rear-stage trigger 32*a* is put into the outer cylinder 1, and when rear-stage trigger 32*a* moves forward along the direction from well head to well bottom and reaches the rear-stage sliding sleeve 21*a*, the rear-stage triggering structure 321 identifies and connects the rear-stage identification structure a1 and drives the rear-stage sliding sleeve 21*a* to move forward along the direction from well head to well bottom and open the wall through hole 10 (preferably with relatively high height) previously closed by the rear-stage sliding sleeve 21*a*.

In step B, after the rear-stage trigger 32*a* made of soluble or degradable materials is dissolved or degraded, the preceding-stage trigger 31*a* is put into the outer cylinder 1, and when the preceding-stage trigger 31*a* moves forward along the direction from well head to well bottom, passes through the rear-stage identification structure a1 of the rear-stage sliding sleeve 21*a*, and reaches the preceding-stage sliding sleeve 21*b*, the preceding-stage triggering structure 311 identifies and connects with the preceding-stage identification structure a2 and drives the preceding-stage sliding sleeve 21*b* to move forward along the direction from well head to well bottom and open the wall through hole 10

(preferably with relatively low height) previously closed by the preceding-stage sliding sleeve 21*b*.

If the rear-stage trigger 32*a* is put in first because of misoperation or special requirements, the preceding-stage trigger 31*a* can be put in after the rear-stage trigger 32*a* is degraded or dissolved.

To sum up, in the disclosure, different identification structures (which can also be called identification buttons) are set in advance on the sliding sleeve 21, which is the required control point of the switch sliding sleeve 21 device (which can also be called tool string). When the device is equipped in the well, the triggers 3 (also called controller or control seat) with the same diameter but different triggering structure (also called identification code) are put in. Only when the identification code corresponds to the identification button on the sliding sleeve 21 (also called control seat) can it set. If the identification code is larger than the identification button, it will pass the identification button and move to the lower stream of the tool string until it corresponds to the corresponding identification code and then sets.

The disclosure has the following characteristics:

1. The tool string is provided with identification buttons with the same diameter but different parameters.

2. The controller is provided with identification codes with the same diameter but different parameters, which correspond to the respective identification buttons.

3. The identification codes can set on the corresponding identification buttons.

4. All the identification buttons at the upper stream can't set the identification code corresponding to the lower stream.

As a preferred embodiment of the disclosure, switch sliding sleeve device for oil-gas exploitation of the disclosure includes an outer cylinder, a trigger and a sliding sleeve.

The inner cavity of the outer cylinder forms an internal fluid channel, and the sidewall of the outer cylinder is provided with a plurality of wall through hole which are communicated with the internal fluid channel and have different heights and positions.

Sliding sleeves include first stage to N-th stage sliding sleeves, N≥2, the specific number of N is set according to the depth of well or actual needs, and the first stage sliding sleeve is closest to the well bottom.

The first stage to the N-th stage sliding sleeves are respectively connected with the outer cylinder in a sliding or detachable way.

The triggers include first stage to N-th stage triggers, the outer wall of the first stage trigger is provided with a first stage triggering structure, and the inner wall of the first stage sliding sleeve is provided with a lower identification structure corresponding to the first stage trigger.

Triggering structures are arranged on the outer walls of other triggers, and identification structures corresponding to respective triggers are arranged on the inner walls of the respective stage sliding sleeves.

The first stage trigger is put into the outer cylinder, and when the first stage trigger moves downward, passes through the N-th to the second stage sliding sleeve identification structures in turn until reaching the first stage sliding sleeve, the first stage triggering structure is capable of identifying and connecting with the first stage identification structure, driving the first stage sliding sleeve to move downward together and open the wall through hole with relatively low height previously closed by the first stage sliding sleeve.

The second stage to N-th stage triggers are respectively put into the outer cylinder in turn, and when the respective stages of triggers move forward along the direction from well head to well bottom and reach the corresponding stage of sliding sleeve, the respective stages of triggering structures are capable of identifying and connecting with the corresponding stage of identifying structure and drive the corresponding stage of sliding sleeve to move forward along the direction from well head to well bottom, and open the wall through hole previously closed by the respective stage of sliding sleeves (preferably with relatively high position and height).

The inner diameters R of the inner walls of the respective stages of sliding sleeves are the same.

In this embodiment, the parts of the respective stages of triggers excluding the triggering structures have outer walls with coincident projections in the axial direction.

The respective stages of triggering structures are formed by sidewalls of grooves with different width sizes, and the respective stages of identification structures are protrusions with different sizes. Or, the respective stages of triggering structures are protrusions with different sizes, and the respective stages of identification structures are sidewalls of grooves with different width sizes.

In this embodiment, the length direction of the protrusion extends along the axial direction, and the shape of the axial section of the protrusion is oblong, oval or round.

In this embodiment, all of the respective stages of triggering structures are formed by the sidewalls of the grooves, and all of the respective stages of triggers include a blocking body, an outer boss and a groove, respectively.

The blocking body includes a conical lower part and a cylindrical upper part. The outer boss is fixedly arranged on the outer wall of the upper part of the blocking body, and the outer diameter size of the outer boss is larger than the maximum outer diameter size of the blocking body, and the groove runs through the outer boss along the axial direction.

In one embodiment, the number of grooves on the outer wall of each stage of trigger and protrusion on the inner wall of each stage of sliding sleeve are the same, and the number is one or two.

In one embodiment, the number of grooves on the outer wall of each stage of trigger and protrusions on the inner wall of each stage of sliding sleeve are the same, and the number is at least two.

Grooves are evenly distributed on the outer wall of each stage of trigger along the circumferential direction, and protrusions are evenly distributed on the inner wall of each stage of sliding sleeve along the circumferential direction.

In this embodiment, each stage of identification structure is arranged at the upper part of the corresponding stage of sliding sleeve.

In this embodiment, when respective stages of triggers are put into the outer cylinder, the respective stages of triggers move forward along the direction from well head to well bottom under the action of self-weight.

In this embodiment, among the outer cylinder, the respective stages of triggers and sliding sleeves, at least the respective stages of triggers are made of soluble or degradable materials.

In this embodiment, the inner diameters R of the all axial sections of the inner wall of the outer cylinder are the same.

The inner diameter R of all axial sections of the part of the inner wall of the respective stages of sliding sleeve excluding the identification structures are the same.

The outer diameter of all axial sections of the part of the outer wall of the respective stages of triggers excluding the triggering structures are the same.

In this embodiment, when the respective stages of sliding sleeves move forward along the direction from well head to well bottom and open the wall through hole previously closed by the respective stages of sliding sleeves, the respective stages of triggers provided with the corresponding stages of trigging structures set and close the upper port of the preceding-stage sliding sleeve.

In this embodiment, the outer cylinder includes a cylinder body, an upper joint, a lower joint, a nozzle wall plate and a sealing ring.

The upper joint is detachably connected with the upper end of the cylinder body, and the lower joint is detachably connected with the lower end of the cylinder body. When the sliding sleeve opens the wall through hole, the bottom end of the sliding sleeve abuts against the lower joint, and the respective stages of triggers are embedded in corresponding stages of sliding sleeves.

The nozzle wall plate is arranged on the opening of the wall of the cylinder body, and the wall through hole is formed by the through hole arranged on the nozzle wall plate. The sealing ring is interposed among the nozzle wall plate, the wall of the cylinder body and the sliding sleeve at the position of closing the wall through hole, and the sliding sleeve temporarily stays at the position of closing the wall through hole under the friction of the sealing ring.

As an embodiment of the disclosure, the oil-gas exploitation tool provided by the embodiment of the disclosure includes the switch sliding sleeve device for oil-gas exploitation provided by any technical solution of the disclosure, and the oil-gas exploitation tool is a sliding sleeve tool or a packer.

As an embodiment of the disclosure, the switching method of the switch sliding sleeve device for oil-gas exploitation includes the following steps A and B.

In step A, a first stage trigger is put into an outer cylinder, and when the first stage trigger moves downward and passes through the respective stages of identification structures of the N-th stage to second stage sliding sleeves in sequence until reaches the first stage sliding sleeve, and the first stage triggering structure identifies and connects the first stage identification structure and drives the first stage sliding sleeve to move downward together and open the wall through hole with a relatively low height previously closed by the first stage sliding sleeve.

In step B, a second stage trigger is put into the outer cylinder, and when the second stage trigger moves downward to the second stage sliding sleeve, the second stage triggering structure identifies and connects with the second stage identification structure and drives the second stage sliding sleeve to move downward together and open the wall through hole (preferably with a relatively high height) previously closed by the second stage sliding sleeve. And so on, the respective stages of triggers are triggered respectively in a sequence from a preceding one to a rear one, until the N-th stage trigger opens the N-th stage sliding sleeve.

Or, the switching method includes the following steps A and B.

In step A, the N-th stage trigger is put into the outer cylinder, and when the N-th stage trigger moves forward along the direction from well head to well bottom and reaches the N-th sliding sleeve, the N-th triggering structure identifies and connects with the N-th stage identification structure and drives the N-th stage sliding sleeve to move forward along the direction from well head to well bottom and open the wall through hole (preferably with a relatively high height) previously closed by the N-th stage sliding sleeve.

In step B, after the N-th stage trigger made of dissolvable or degradable materials is dissolved or degraded, the (N−1) th stage trigger is put into the outer cylinder, and when the (N−1)th stage trigger moves forward along the direction from well head to well bottom and passes through the N-th stage identification structure of the N-th stage sliding sleeve until it reaches the (N−1)th stage sliding sleeve, the (N−1)th stage triggering structure identifies and connects with the (N−1)th stage identification structure and drives the (N−1)th stage sliding sleeve to move downward together along the direction from well head to well bottom and open the wall through hole (preferably with a relatively low height) previously closed by the (N−1)th stage sliding sleeve.

The above is only specific embodiments of the disclosure, but the protection scope of the disclosure is not limited to this. Those of ordinary skill in the art can easily think of changes or substitutions within the technical scope disclosed by the disclosure, which should be covered within the protection scope of the disclosure. Therefore, the protection scope of the disclosure shall be subject to the protection scope of the claims.

What is claimed is:

1. A switch sliding sleeve device for oil-gas exploitation, comprising an outer cylinder, a switch sliding sleeve mechanism and a trigger, wherein, a wall of the outer cylinder is provided with a wall through hole capable of connecting an internal fluid channel of the outer cylinder with outside of the outer cylinder, and the switch sliding sleeve mechanism is arranged inside the outer cylinder;

an extension direction of an axial line of a center hole of the switch sliding sleeve mechanism coincides with or is parallel to an extension direction of an axial line of the outer cylinder;

the switch sliding sleeve mechanism is capable of being switched from a first state of opening the wall through hole to a second state of closing the wall through hole when the trigger is put into the outer cylinder and punching triggers the switch sliding sleeve mechanism, and switching from the second state of closing the wall through hole back to the first state of opening the wall through hole until the switch sliding sleeve mechanism is triggered by the trigger or another trigger again; or, the switch sliding sleeve mechanism is capable of being switched from the second state of closing the wall through hole to the first state of opening the wall through hole when the trigger is put into the outer cylinder and punching triggers the switch sliding sleeve mechanism, and switching from the first state of opening the wall through hole back to the second state of closing the wall through hole until the switch sliding sleeve mechanism is triggered by the trigger or another trigger again;

the number of triggers is two or more, the trigger put into the outer cylinder for the first time is first trigger, the trigger or another trigger put into the outer cylinder again is second trigger, and the first trigger and/or the second trigger are made of soluble or degradable materials;

the switch sliding sleeve mechanism comprises a sliding sleeve, a seat body and fluid medium, wherein, the seat body and the outer cylinder are connected with each other or are in an integral structure;

a liquid-tight fluid medium accommodating chamber is formed among the sliding sleeve, the seat body and the outer cylinder; or, the switch sliding sleeve mechanism further comprises a liquid-tight retaining ring liquid-tightly connected to an inner side of the sliding sleeve, and a liquid-tight fluid medium accommodating chamber is formed among the sliding sleeve, the seat body, the outer cylinder and the liquid-tight retaining ring;

the fluid medium is filled in the fluid medium accommodating chamber;

the sliding sleeve comprises an inner sliding sleeve and an outer sliding sleeve sleeved outside the inner sliding sleeve, wherein, a wall of the outer sliding sleeve is provided with a radial opening, and when one of the first trigger and the second trigger is put into the outer cylinder to punch an upstream end of one of the inner sliding sleeve and the outer sliding sleeve, the punched sliding sleeve of the inner sliding sleeve and the outer sliding sleeve moves downward and pushes the non-punched sliding sleeve of the inner sliding sleeve and the outer sliding sleeve to move upward through the fluid medium, so that the radial opening of the outer sliding sleeve and the wall through hole are staggered with each other, or the inner sliding sleeve blocks the wall through hole, and thus the wall through hole is closed, and when another one of the first trigger and the second trigger is put into the outer cylinder to punch another one of the inner sliding sleeve and the outer sliding sleeve, the punched sliding sleeve moves downward and pushes the non-punched sliding sleeve to move upward through the fluid medium, so that the radial opening of the outer sliding sleeve coincides with the wall through hole, and the inner sliding sleeve no longer blocks the radial opening of the outer sliding sleeve and the wall through hole, and thus the wall through hole is open;

or, the wall of the outer sliding sleeve is provided with a radial opening, and when one of the first trigger and the second trigger is put into the outer cylinder to punch an upstream end of one of the inner sliding sleeve and the outer sliding sleeve, the punched sliding sleeve of the inner sliding sleeve and the outer sliding sleeve moves downward and pushes the non-punched sliding sleeve of the inner sliding sleeve and the outer sliding sleeve to move upward through the fluid medium, so that the radial opening of the outer sliding sleeve coincides with the wall through hole, the inner sliding sleeve no longer blocks the radial opening of the outer sliding sleeve and the wall through hole, and thus the wall through hole is open, and when another one of the first trigger and the second trigger is put into the outer cylinder to punch another one of the inner sliding sleeve and the outer sliding sleeve, the punched sliding sleeve moves downward and pushes the non-punched sliding sleeve to move upward through the fluid medium, so that the radial opening of the outer sliding sleeve and the wall through hole are staggered with each other, or the inner sliding sleeve blocks the wall through hole, and thus the wall through hole is closed;

or, the wall of the outer sliding sleeve is not provided with a radial opening, and when one of the first trigger and the second trigger is put into the outer cylinder to punch an upstream end of the inner sliding sleeve, the inner sliding sleeve moves downward to close the wall through hole, and the inner sliding sleeve moving downward pushes the outer sliding sleeve to move upward through the fluid medium, and when another one of the first trigger and the second trigger is put into the outer cylinder to punch the outer sliding sleeve, the punched outer sliding sleeve moves downward and pushes the non-punched inner sliding sleeve to move upward through the fluid medium, so that the inner sliding sleeve no longer blocks the wall through hole, and thus the wall through hole is open.

2. The switch sliding sleeve device for oil-gas exploitation according to claim 1, wherein, the first trigger and/or the second trigger is a sphere, ellipsoid, cylindrical structure or truncated cone structure.

3. The switch sliding sleeve device for oil-gas exploitation according to claim 1, wherein, the upstream end of the outer sliding sleeve has a larger port size than the upstream end of the inner sliding sleeve has, the first trigger and the second trigger are both spheres, and the diameter of the first trigger is different from that of the second trigger;

or, one of the first trigger and the second trigger only matches with the shape of the outer sliding sleeve and is only capable of driving the matched outer sliding sleeve downward, and the other one of the first trigger and the second trigger only matches with the shape of the inner sliding sleeve and is only capable of driving the matched inner sliding sleeve downward.

4. The switch sliding sleeve device for oil-gas exploitation according to claim 3, wherein, the first trigger has an outer wall provided with a first triggering structure, and the outer sliding sleeve is provided with a first identification structure corresponding to the first triggering structure; the second trigger has an outer wall provided with a second triggering structure, and the inner sliding sleeve is provided with a second identification structure corresponding to the second triggering structure;

when the first trigger is put in, and the first trigger moves forward along a direction from well head to well bottom and reaches the first identification structure of the outer sliding sleeve, the first triggering structure is capable of identifying and connecting with the first identification structure, driving the outer sliding sleeve to move forward along the direction from well head to well bottom and opening the wall through hole previously closed by the outer sliding sleeve, and the outer sliding sleeve moving downward pushes the inner sliding sleeve to move upward through the fluid medium;

when the second trigger is put in, and the second trigger moves forward along the direction from well head to well bottom and reaches the inner sliding sleeve, the second triggering structure is capable of identifying and connecting with the second identification structure, driving the inner sliding sleeve to move forward along the direction from well head to well bottom and pushing the outer sliding sleeve to move upward through the fluid medium to close the wall through hole;

the inner diameter size of the second identification structure is the same as that of the first identification structure, and the cross-sectional shapes of the second identification structure and the first identification structure are different.

5. The switch sliding sleeve device for oil-gas exploitation according to claim 3, wherein, the fluid medium is hydraulic oil, water or particles with fluidity; and/or the upstream ends of the inner sliding sleeve and the outer sliding sleeve are respectively provided with conical inner surfaces or are respectively fixedly connected with ball seats provided with conical inner surfaces, and the inner diameter size of the conical inner surfaces gradually reduces along a direction from upstream to downstream.

6. The switch sliding sleeve device for oil-gas exploitation according to claim 3, wherein, the outer sliding sleeve is provided with a stop flange, and when the outer sliding sleeve moves downward to a position of closing the wall through hole, the stop flange abuts against the upstream end of the inner sliding sleeve; and/or the wall of the inner sliding sleeve is provided with an inner wall opening, the wall through hole is in an open state when the radial opening of the outer sliding sleeve, the inner wall opening of the inner sliding sleeve and the wall through hole coincide, and the wall through hole is in a closed state when the radial opening of the outer sliding sleeve, the inner wall opening of the inner sliding sleeve and the wall through hole are staggered; or, the wall through hole is in an open state when the radial opening of the outer sliding sleeve and the wall through hole coincide and are not blocked by the inner sliding sleeve, and the wall through hole is in a closed state when the radial opening of the outer sliding sleeve and the wall through hole are staggered or one of the radial opening of the outer sliding sleeve and the wall through hole is blocked by the inner sliding sleeve.

7. A switch sliding sleeve device for oil-gas exploitation, comprising an outer cylinder, a switch sliding sleeve mechanism and a trigger, wherein, a wall of the outer cylinder is provided with a wall through hole capable of connecting an internal fluid channel of the outer cylinder with outside of the outer cylinder, and the switch sliding sleeve mechanism is arranged inside the outer cylinder;

an extension direction of an axial line of a center hole of the switch sliding sleeve mechanism coincides with or is parallel to an extension direction of an axial line of the outer cylinder;

the switch sliding sleeve mechanism is capable of being switched from a first state of opening the wall through hole to a second state of closing the wall through hole when the trigger is put into the outer cylinder and punching triggers the switch sliding sleeve mechanism, and switching from the second state of closing the wall through hole back to the first state of opening the wall through hole until the switch sliding sleeve mechanism is triggered by the trigger or another trigger again; or, the switch sliding sleeve mechanism is capable of being switched from the second state of closing the wall through hole to the first state of opening the wall through hole when the trigger is put into the outer cylinder and punching triggers the switch sliding sleeve mechanism, and switching from the first state of opening the wall through hole back to the second state of closing the wall through hole until the switch sliding sleeve mechanism is triggered by the trigger or another trigger again, wherein the switch sliding sleeve device is applied in an oil-gas well and comprises an outer cylinder, a trigger and a sliding sleeve, wherein, an inner cavity of the outer cylinder forms an internal fluid channel, and a sidewall of the outer cylinder is provided with a wall through hole;

the sliding sleeve comprises a rear-stage sliding sleeve and a preceding-stage sliding sleeve which are slidably or detachably connected to the outer cylinder;

the trigger comprises a preceding-stage trigger and a rear-stage trigger, the preceding-stage trigger has an outer wall provided with a preceding-stage triggering structure, and the preceding-stage sliding sleeve has an inner wall provided with a preceding-stage identification structure corresponding to the preceding-stage triggering structure;

the rear-stage trigger has an outer wall provided with a rear-stage triggering structure, and the rear-stage sliding sleeve has an inner wall provided with a rear-stage identification structure corresponding to the rear-stage triggering structure;

the preceding-stage sliding sleeve is located closer to the well bottom than the rear-stage sliding sleeve is;

when the preceding-stage trigger is put in, and the preceding-stage trigger moves forward along a direction from well head to well bottom, passes through the rear-stage identification structure of the rear-stage sliding sleeve, and reaches the preceding-stage sliding sleeve, the preceding-stage triggering structure is capable of identifying and connecting with the preceding-stage identification structure, driving the preceding-stage sliding sleeve to move forward along the direction from well head to well bottom and open the wall through hole previously closed by the preceding-stage sliding sleeve;

when the rear-stage trigger is put in, and the rear-stage trigger moves forward along the direction from well head to well bottom and reaches the rear-stage sliding sleeve, the rear-stage triggering structure is capable of identifying and connecting with the rear-stage identification structure, driving the rear-stage sliding sleeve to move forward along the direction from well head to well bottom and open the wall through hole previously closed by the rear-stage sliding sleeve;

the inner diameter size of the rear-stage recognition structure is the same as that of the preceding-stage recognition structure, and the cross-sectional shapes of the rear-stage recognition structure and the preceding-stage recognition structure are different.

8. The switch sliding sleeve device for oil-gas exploitation according to claim 7, wherein the number of the rear-stage sliding sleeve or the preceding-stage sliding sleeve is one, two, three or more, wherein, the preceding-stage triggering structure and the rear-stage triggering structure are formed by sidewalls of grooves with different width sizes, and the rear-stage recognition structure and the preceding-stage recognition structure are protrusions with different sizes;

or, the preceding-stage triggering structure and the rear-stage triggering structure are protrusions with different sizes, and the rear-stage recognition structure and the preceding-stage recognition structure are formed by sidewalls of grooves with different width sizes;

or, the preceding-stage triggering structure and the rear-stage triggering structure are formed by sidewalls of different numbers of grooves, and the rear-stage identification structure and the preceding-stage identification structure are different numbers of protrusions;

or, the preceding-stage triggering structure and the rear-stage triggering structure are different numbers of protrusions, and the rear-stage recognition structure and the preceding-stage recognition structure are formed by sidewalls of different numbers of grooves.

9. The switch sliding sleeve device for oil-gas exploitation according to claim 8, wherein, the length direction of the protrusion extends along the axial direction of the device, and the shape of the axial section of the protrusion is oblong, oval or round; and/or, the preceding-stage triggering structure and the rear-stage triggering structure are both formed by sidewalls of grooves, and each of the preceding-stage trigger and the rear-stage trigger comprises a blocking body, an outer boss and the groove, wherein the blocking body comprises a conical lower part and a cylindrical upper part, the outer boss is fixedly arranged on an outer wall of the upper part of the blocking body, and the outer diameter size of the outer boss is larger than the maximum outer diameter size of the blocking body; and the groove runs through the outer boss along the axial direction.

10. The switch sliding sleeve device for oil-gas exploitation according to claim 9, wherein the width direction of the groove is parallel to the circumferential direction of the outer cylinder, and the width size of the groove gradually reduces along the direction from the well bottom to the well head, wherein, the width size of the narrowest section of the groove is 1/20 to 1/5 of the outer diameter size of the outer boss; and/or, the width size of the widest section of the protrusion is 1/20 to 1/5 of the inner diameter size of the outer cylinder; and/or the radial size of the protrusion is 1/40 to 1/5 of the inner diameter size of the outer cylinder.

11. The switch sliding sleeve device for oil-gas exploitation according to claim 8, wherein, the groove has a sidewall formed by smooth transition between a curved surface and a flat surface; and/or, the grooves on the outer wall of the preceding-stage trigger and the grooves on the outer wall of the rear-stage trigger are of the same number but of different width sizes, or are of different numbers but of the same width size.

12. The switch sliding sleeve device for oil-gas exploitation according to claim 11, wherein, the grooves on the outer wall of the preceding-stage trigger, the grooves on the outer wall of the rear-stage trigger, the protrusions on the inner wall of the rear-stage sliding sleeve and the protrusions on the inner wall of the preceding-stage sliding sleeve are all of the same number, and a plurality of said grooves are evenly distributed on the outer wall of the rear-stage trigger or the preceding-stage trigger along the circumferential direction, and a plurality of said protrusions are evenly distributed on the inner wall of the rear-stage sliding sleeve or the preceding-stage sliding sleeve along the circumferential direction.

13. The switch sliding sleeve device for oil-gas exploitation according to claim 7, wherein, the rear-stage identification structure is arranged at an upper or middle part of the rear-stage sliding sleeve, and the preceding-stage identification structure is arranged at an upper or middle part of the preceding-stage sliding sleeve; and/or, the part of the rear-stage sliding sleeve excluding the rear-stage identification structure and the part of the preceding-stage sliding sleeve excluding the preceding-stage identification structure have inner walls with coincident projections in the direction from well head to well bottom, and the preceding-stage triggering structure and the rear-stage triggering structure have the same outer diameter size, when the preceding-stage trigger and the rear-stage trigger are put into the outer cylinder, they move forward along the direction from well head to well bottom under the action of self-weight or external thrust; and/or, among the outer cylinder, the preceding-stage trigger, the rear-stage trigger and the sliding sleeve, at least the preceding-stage trigger and the rear-stage trigger are made of soluble or degradable materials; and/or, the respective axial sections of the outer cylinder have inner walls with the same inner diameter, the respective axial sections of the part of the rear-stage sliding sleeve excluding the rear-stage identification structure and the part of the preceding-stage sliding sleeve excluding the preceding-stage identification structure have inner walls with the same inner diameter, and the respective axial sections of the part of the preceding-stage trigger excluding the preceding-stage triggering structure and the part of the rear-stage trigger excluding the rear-stage trigging structure have outer walls with the same outer diameter; and/or, when the preceding-stage sliding sleeve moves forward along the direction from well head to well bottom and opens the wall through hole previously closed by the preceding-stage sliding sleeve, the preceding-stage trigger provided with the preceding-stage triggering structure sets and closes the inner channel of the preceding-stage sliding sleeve; when the rear-stage sliding sleeve moves forward along the direction from well head to well bottom and opens the wall through hole previously closed by the rear-stage sliding sleeve, the rear-stage trigger provided with the rear-stage triggering structure sets and closes the inner channel of the rear-stage sliding sleeve.

14. The switch sliding sleeve device for oil-gas exploitation according to claim 7, wherein the outer cylinder comprises a cylinder body, an upper joint, a lower joint, a nozzle wall plate and a sealing ring, wherein, the upper joint is detachably connected with an upper end of the cylinder body, and the lower joint is detachably connected with an lower end of the cylinder body; when the sliding sleeve opens the wall through hole, the bottom end of the sliding sleeve abuts against the lower joint; the preceding-stage trigger is embedded in the preceding-stage sliding sleeve or the rear-stage trigger is embedded in the rear-stage sliding sleeve;

the nozzle wall plate is arranged on an opening of the wall of the cylinder body, the wall through hole is formed by a through hole provided on the nozzle wall plate, the sealing ring is interposed among the nozzle wall plate, a wall of the cylinder body and the sliding sleeve at a position of closing the wall through hole, and the sliding sleeve temporarily stays at the position of closing the wall through hole under friction of the sealing ring until the trigger drives the sliding sleeve to move forward and open the wall through hole previously closed by the sliding sleeve.

15. A switching method of a switch sliding sleeve device for oil-gas exploitation according to claim 9, the switching method comprising:

putting the preceding-stage trigger into the outer cylinder, and when the preceding-stage trigger moves forward along the direction from well head to well bottom, passes through the rear-stage identification structure of the rear-stage sliding sleeve and reaches the preceding-stage sliding sleeve, the preceding-stage triggering structure identifying and connecting with the preceding-stage identification structure and driving the preceding-stage sliding sleeve to move forward along the direction from well head to well bottom and open the wall through hole previously closed by the preceding-stage sliding sleeve; and putting the rear-stage trigger into the outer cylinder, and when the rear-stage trigger moves forward along the direction from well head to well bottom and reaches the rear-stage sliding sleeve, the rear-stage triggering structure identifying and connecting with the rear-stage identification structure and driving the rear-stage sliding sleeve to move forward along the direction from well head to well bottom and open the wall through hole previously closed by the rear-stage sliding sleeve, or, the switching method comprising:

putting the rear-stage trigger into the outer cylinder, and when the rear-stage trigger moves forward along the direction from well head to well bottom and reaches the rear-stage sliding sleeve, the rear-stage triggering structure identifying and connecting with the rear-stage identification structure and driving the rear-stage sliding sleeve to move forward along the direction from well head to well bottom and open the wall through hole previously closed by the rear-stage sliding sleeve; and after the rear-stage trigger made of soluble or degradable material is dissolved or degraded, putting the preceding-stage trigger into the outer cylinder, and when the preceding-stage trigger moves forward along the direction from well head to well bottom, passes through the rear-stage identification structure of the rear-stage sliding sleeve and reaches the preceding-stage sliding sleeve, the preceding-stage triggering structure identifying and connecting with the preceding-stage identification structure and driving the preceding-stage sliding sleeve to move forward along the direction from well head to well bottom and open the wall through hole previously closed by the preceding-stage sliding sleeve.

16. An oil-gas exploitation tool, comprising the switch sliding sleeve device for oil-gas exploitation according to claim 1, wherein the oil-gas exploitation tool is a sliding sleeve tool or a packer.

17. The oil-gas exploitation tool according to claim 16, wherein, the oil-gas exploitation tool is a packer, the packer includes a rubber cylinder and a fluid channel, when the wall through hole is in an open state, the fluid in the internal fluid channel of the outer cylinder is capable of sequentially flowing through the wall through hole and the fluid channel to push the rubber cylinder to deform and set in a casing or oil-gas well where the packer is located;

when the wall through hole is in a closed state, the fluid in the fluid channel is capable of keeping the rubber cylinder deforming and setting in the casing or oil-gas well where the packer is located;

when the wall through hole is in a open state again, the fluid in the fluid channel flows through the fluid channel and the wall through hole and into the internal fluid channel of the outer cylinder to restore the shape of the rubber cylinder before setting and release setting.

18. A switching method of a wall through hole of an oil-gas exploitation tool according to claim 16, the switching method comprising:

putting a trigger into the outer cylinder of the switch sliding sleeve device for oil-gas exploitation according to claim 1, the switch sliding sleeve mechanism is capable of being switched from the first state of opening the wall through hole to the second state of closing the wall through hole when the trigger is put into the outer cylinder and punching triggers the switch sliding sleeve mechanism; and putting the trigger or another trigger into the outer cylinder again, and the switch sliding sleeve mechanism is capable of being switched from the second state of closing the wall through hole to the first state of opening the wall through hole when the switch sliding sleeve mechanism is triggered by the trigger or another trigger again;

or, the switching method comprising:

putting a trigger into the outer cylinder of the switch sliding sleeve device for oil-gas exploitation according to claim 1, the switch sliding sleeve mechanism is capable of being switched from the second state of closing the wall through hole to the first state of opening the wall through hole when the trigger is put into the outer cylinder and punching triggers the switch sliding sleeve mechanism; and putting the trigger or another trigger into the outer cylinder again, and the switch sliding sleeve mechanism is capable of being switched from the first state of opening the wall through hole to the second state of closing the wall through hole when the switch sliding sleeve mechanism is triggered by the trigger or another trigger again.

19. An oil-gas exploitation tool, comprising the switch sliding sleeve device for oil-gas exploitation according to claim 7, wherein the oil-gas exploitation tool is a sliding sleeve tool or a packer.

* * * * *